US009421587B2

(12) United States Patent
Matsui

(10) Patent No.: US 9,421,587 B2
(45) Date of Patent: Aug. 23, 2016

(54) PALLET WIPING DEVICE, PALLET CLEANING DEVICE, AND PALLET WORK LINE

(75) Inventor: Takanobu Matsui, Tokyo (JP)

(73) Assignee: JAPAN PALLET RENTAL CORPORATION, Tokyo (JP)

( * ) Notice: Subject to any disclaimer, the term of this patent is extended or adjusted under 35 U.S.C. 154(b) by 484 days.

(21) Appl. No.: 14/112,223

(22) PCT Filed: Mar. 26, 2012

(86) PCT No.: PCT/JP2012/057781

§ 371 (c)(1),
(2), (4) Date: Nov. 14, 2013

(87) PCT Pub. No.: WO2012/144296

PCT Pub. Date: Oct. 26, 2012

(65) Prior Publication Data

US 2014/0053880 A1 Feb. 27, 2014

(30) Foreign Application Priority Data

Apr. 18, 2011 (JP) ..... P2011-091971

(51) Int. Cl.
*F26B 9/00* (2006.01)
*B08B 3/10* (2006.01)
(Continued)

(52) U.S. Cl.
CPC ... *B08B 3/10* (2013.01); *B08B 1/02* (2013.01); *B08B 3/022* (2013.01); *F26B 5/16* (2013.01); *F26B 15/12* (2013.01)

(58) Field of Classification Search
CPC ..... F26B 3/00; F26B 3/08; F26B 9/00; F26B 9/106; F26B 21/00; F26B 21/06; B08B 3/00; B08B 3/04; B66F 11/00; B61B 9/00
USPC ..... 34/200, 210, 218, 237; 134/61, 62; 108/55.1, 55.3, 57.17, 57.26; 104/172.3
See application file for complete search history.

(56) References Cited

U.S. PATENT DOCUMENTS 2,095,319 A * 10/1937 Drake ..... F26B 25/185 105/160.5
5,133,296 A * 7/1992 Crawford ..... A01K 1/0155 119/172

(Continued)

FOREIGN PATENT DOCUMENTS

JP 63165213 A * 7/1988
JP 02-307582 12/1990

(Continued)

OTHER PUBLICATIONS

International Search Report from the Japanese Patent Office in corresponding Japanese Patent Application No. PCT/JP2012/057781, mailed Jun. 26, 2012, 1 page.

(Continued)

*Primary Examiner* — Stephen M Gravini
(74) *Attorney, Agent, or Firm* — Nicholas Trenkle; Stites & Harbison, PLLC.

(57) ABSTRACT

A pallet wiping device that promotes drying after washing of a pallet includes a pallet placement unit on which a pallet is placed, and a wiping unit including a water-absorbing portion formed of a water-absorbent material, an arm supporting the water-absorbing portion and connected to a cylinder, and a cylinder. The cylinder moves the arm reciprocally along a direction in which a fork insertion hole extends while bringing the water-absorbing portion into contact with the inner wall surface of the fork insertion hole. Accordingly, water left in the fork insertion hole of the pallet after washing can be removed. In addition, the pallet can be dried at low cost because removal of water in the interior of the fork insertion hole is implemented without using heat.

18 Claims, 21 Drawing Sheets

(51) Int. Cl.

| | |
|---|---|
| ***F26B 5/16*** | (2006.01) |
| ***B08B 1/02*** | (2006.01) |
| ***B08B 3/02*** | (2006.01) |
| *F26B 15/12* | (2006.01) |

(56) References Cited

U.S. PATENT DOCUMENTS

| | | | | | |
|---|---|---|---|---|---|
| 5,704,134 | A * | 1/1998 | Carter | F26B 25/185 | 211/59.4 |
| 5,839,206 | A * | 11/1998 | Lisson | G21F 9/08 | 34/132 |
| 6,134,803 | A * | 10/2000 | Gilchrist | F26B 25/185 | 34/239 |
| 6,598,847 | B2 * | 7/2003 | Doucet | B65D 71/0092 | 108/56.3 |
| 6,644,776 | B1 * | 11/2003 | Barinaga | B41J 2/16538 | 347/33 |
| 6,898,868 | B2 * | 5/2005 | Vermeulen | B65B 53/066 | 219/427 |
| 7,024,797 | B2 * | 4/2006 | Bessa | F26B 25/18 | 34/103 |
| 7,963,048 | B2 * | 6/2011 | Pollard | F26B 15/12 | 110/315 |
| 7,987,614 | B2 * | 8/2011 | Erickson | F26B 7/00 | 100/50 |
| 8,028,438 | B2 * | 10/2011 | Pedtke | F24F 13/222 | 106/222 |
| 2008/0135061 | A1 * | 6/2008 | Madgar | B08B 7/0035 | 134/1 |
| 2009/0095172 | A1 * | 4/2009 | Madgar | B05B 13/0221 | 101/118 |
| 2013/0112229 | A1 * | 5/2013 | White | B08B 3/022 | 134/62 |
| 2014/0053880 | A1 * | 2/2014 | Matsui | F26B 5/16 | 134/61 |
| 2014/0090672 | A1 * | 4/2014 | Matsui | B08B 5/02 | 134/61 |
| 2014/0147640 | A1 * | 5/2014 | Budi | B27K 5/04 | 428/195.1 |
| 2015/0082657 | A1 * | 3/2015 | Goyette | A23L 3/40 | 34/475 |
| 2015/0259941 | A1 * | 9/2015 | Hanson | B60S 5/00 | 52/31 |

FOREIGN PATENT DOCUMENTS

| | | | | |
|---|---|---|---|---|
| JP | 03-242273 | | 10/1991 | |
| JP | H08164372 | A | 6/1996 | |
| JP | 2010-125388 | | 6/2010 | |
| JP | WO 2012144296 | A1 * | 10/2012 | F26B 5/16 |
| TW | M307598 | | 3/2007 | |

OTHER PUBLICATIONS

Notification of Transmittal of Translation of the International Preliminary Report on Patentability (IPRP) and the Written Opinion from the International Bureau in counterpart International Application No. PCT/JP2012/057781, dated Nov. 14, 2013, pp. 1-5.

Office Action dated Jan. 12, 2016 in corresponding Taiwanese Patent Application No. 101110628.

* cited by examiner (a)

(b)

(a)

(b)

PALLET WIPING DEVICE, PALLET CLEANING DEVICE, AND PALLET WORK LINE

TECHNICAL FIELD

The present invention relates to a pallet wiping device, a pallet washing device, and a pallet work line.

BACKGROUND ART

Pallets formed of resin such as plastic are used for transporting goods in a variety of industries. As pallets are repeatedly used, pallets that are used a certain number of times require washing. Resin pallets are washed, for example, with water or liquid cleaner. To reuse the washed pallets, the pallets have to be dried. In a conventional pallet washing step, for example, water left on a pallet is removed with a blower. A method of promoting drying of a pallet by blowing hot air onto the pallet with a blower and a method of promoting drying after washing by heating wash water are known. A pallet washing system is also known, which dries a pallet by hot air after the pallet is centrifugally spun for dewatering (see, for example, Patent Literature 1).

CITATION LIST

Patent Literature

Patent Literature 1: Japanese Patent Application Laid-Open Publication No. 2010-125388

SUMMARY OF INVENTION

Technical Problem

A pallet includes a fork insertion hole to which a fork is inserted.

It is necessary to ensure that the interior of the fork insertion hole is dried after washing. With the method of centrifugally spinning a pallet for dewatering, energy consumption for a power source for spinning the pallet is large, and its cost is high. In addition, the spin of a pallet having a heavy weight is rapidly accelerated and rapidly decelerated to cause great damage to the device that spins pallets, thereby increasing the maintenance cost. With such a method, the interior of the fork insertion hole is not fully dried, and the interior of the fork insertion hole therefore has to be dried with hot air, which increases the cost for running a device such as a boiler for obtaining hot air. Even with a method of drying a pallet only with a blower, the cost required for a device such as a boiler is increased similarly. With the method of washing a pallet with heated wash water, initial cost and running cost for a heater for heating wash water, and a circulator and a filter for recycling wash water are high.

The present invention is made in view of the problems described above. An object of the present invention is to provide a pallet wiping device, a pallet washing device, and a pallet work line capable of drying the washed pallet reliably at low cost.

Solution to Problem

A pallet wiping device according to an aspect of the present invention promotes drying after washing of a pallet including a fork insertion hole to which a fork is inserted. The pallet wiping device includes: a wiping unit including a water-absorbing portion, an arm, and a power source; and a pallet placement unit on which the pallet is placed at a certain position such that a direction in which the fork insertion hole extends is oriented along a certain direction. The water-absorbing portion is formed of a water-absorbent material. The arm supports the water-absorbing portion and is connected to the power source. The power source moves the arm reciprocally along the certain direction while bringing the water-absorbing portion into contact with an inner wall surface of the fork insertion hole of the pallet placed on the pallet placement unit.

In the pallet wiping device in the embodiment above, the water-absorbing portion supported by the arm reciprocates along the direction in which the fork insertion holes extends while coming into contact with the inner wall surface of the fork insertion hole, so that water left in the fork insertion hole of the pallet after washing can be removed. Accordingly, the pallet can be dried reliably. In addition, the pallet can be dried at low cost because removal of water in the interior of the fork insertion hole is implemented by wiping water with the water-absorbent water-absorbing member without using heat.

In the pallet wiping device according to another aspect, the wiping unit further includes a rail that supports the arm and is provided along the certain direction. The arm is formed with a rod-like member having a cross section smaller than a size of a cross section of the fork insertion hole and having a certain length, supports the water-absorbing portion in proximity to one end, and reciprocates along the rail.

According to the embodiment above, the reciprocation of the arm along the rail moves the water-absorbing portion reciprocally along the direction in which the fork insertion hole extends, so that water left in the fork insertion hole of the pallet after washing can be removed reliably.

In the pallet wiping device according to yet another embodiment, the wiping unit has a pair of such arms spaced apart from each other by a distance corresponding to a distance between two fork insertion holes of the pallet. The pair of arms are connected by an arm coupling portion in proximity to the other ends. The arm coupling member is connected to the power source. The power source moves the arm coupling member reciprocally along the certain direction.

According to the embodiment above, a pair of arms are provided corresponding to two fork insertion holes of a pallet, so that water in the interior of the two fork insertion holes can be removed efficiently.

In the pallet wiping device according to yet another embodiment, the fork insertion hole is provided so as to pass through between parallel side surfaces of the pallet. A pair of such wiping units are arranged along the certain direction so that the pallet placement unit is interposed therebetween. The arm has a length at least half a distance between the parallel side surfaces of the pallet.

According to the embodiment above, when compared with a case where one wiping unit is provided on either one side surface of a pallet, the wiping unit can be provided with a shorter arm, so that the distance over which the arm reciprocates can be reduced. In addition, the rigidity required for the material of the arm is low. Accordingly, the wiping unit can be configured in a small size.

In the pallet wiping device according to yet another embodiment, the water-absorbing portion may be formed with a ground fabric made of cloth and water-absorbent pile provided at least one side surface of the ground fabric. The ground fabric may be provided so as to cover one end of the arm.

Cloth having water-absorbent pile is preferred for the water-absorbing portion because of large water absorbency. According to this embodiment, more suitable water absorbency can be obtained.

Since the pile is flexible, the water-absorbing portion has a good contact property to the inner wall portion of the fork insertion hole to be wiped.

In the pallet wiping device according to yet another embodiment, the water-absorbing portion is made of cloth. The water-absorbing portion is provided so as to cover one end of the arm. According to the embodiment above, the cost for the water-absorbing portion can be reduced.

In the pallet wiping device according to yet another embodiment, the pallet placement unit is provided with a stacker that is a device for stacking pallets. According to this embodiment, the dried pallets can be neatly stacked.

In the pallet wiping device according to yet another embodiment, the wiping unit further includes an air blowing device that outputs air toward the water-absorbing portion. This embodiment can promote evaporation of water contained in the water-absorbing portion as a result of wiping pallets. Accordingly, in a case where one water-absorbing portion is repeatedly used to wipe a plurality of pallets until the water absorbency is deteriorated, the number of pallets to be wiped can be increased.

A pallet washing device according to an embodiment of the present invention is provided for washing a pallet. The pallet washing device includes a washing unit that washes a pallet with water, the pallet wiping device as described above provided at a stage subsequent to the washing unit, and a conveyance unit that conveys a pallet washed in the washing unit to the pallet placement unit of the pallet wiping device.

The pallet wiping device is provided at a stage subsequent to the washing unit, whereby the washed pallet can be dried reliably with the pallet wiping device. A preferred pallet washing device is thus configured.

The pallet wiping device according to another embodiment further includes a stacker that stacks pallets, and wiping means. The stacker includes a supporter that supports a bottom pallet of one or more stacked pallets at a position at a certain height, and a lifter including a table on which a pallet to be stacked is placed. The lifter is capable of raising and lowering the pallet to be stacked with the pallet being placed on the table. The wiping means is provided in the stacker so as to abut on a side surface of a pallet raised by the lifter for cleaning the side surface of the pallet. The lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height. The supporter supports the pallet to be stacked that is raised by the lifter, at the position at a certain height. The table of the lifter is included in the pallet placement unit.

In the embodiment above, the pallet wiping device includes a stacker for stacking pallets. In this stacker, the stacked pallets are raised in a state in which they are put on a pallet to be stacked. The wiping means is provided so as to abut on the side surface of the raised pallet, so that the pallet side surface is raised in contact with the wiping means whereby dirt, dust, and the like on the side surface of the pallet are removed. Such a configuration is implemented by simply providing the wiping means in the stacker and does not require a special operation mechanism other than the stacker. Accordingly, pallets can be cleaned readily at low cost.

The pallet wiping device according to yet another embodiment further includes an unstacker that unstacks a plurality of stacked pallets one by one, and wiping means. The unstacker includes a supporter that supports a bottom pallet of one or more stacked pallets at a position at a certain height, and a lifter including a table on which a pallet is placed. The lifter is capable of raising and lowering a pallet with the pallet being placed on the table. The wiping means is provided in the unstacker so as to abut on a side surface of a pallet lowered by the lifter for cleaning the side surface of the pallet. The supporter releases support to the bottom pallet in a state in which the lifter supports a lower surface of the bottom pallet from below with the table. The lifter lowers the stacked pallets until a pallet immediately above the bottom pallet of the stacked pallets reaches the position at a certain height. The supporter supports the pallet immediately above the bottom pallet. The lifter lowers the bottom pallet to a certain position with the bottom pallet being placed on the table. The table of the lifter is included in the pallet placement unit.

In the embodiment above, the pallet wiping device includes an unstacker for unstacking the stacked pallets. In this unstacker, when the bottom pallet of the stacked pallets is unstacked, the stacked pallets are lowered by the lifter. The wiping means is provided so as to abut on the side surface of the lowered pallet, so that the pallet side surface is lowered in contact with the wiping means whereby dirt, dust, and the like on the side surface of the pallet are removed. Such a configuration is implemented by simply providing the wiping means in the unstacker and does not require a special operation mechanism other than the unstacker. Accordingly, pallets can be cleaned readily at low cost.

The pallet wiping device according to yet another embodiment further includes a feed line at the table in the lifter of the stacker for moving a pallet to be stacked and placing the moved pallet onto the table. The feed line includes upper surface wiping means provided so as to abut on an upper surface of the pallet moved to the table for cleaning the upper surface of the pallet, and lower surface wiping means provided so as to abut on a lower surface of the pallet for cleaning the lower surface of the pallet.

According to the embodiment above, a feed line for feeding a pallet to be stacked into the stacker is provided. The pallet is moved on this line. The upper surface wiping means and the lower surface wiping means are provided so as to abut on the upper surface and the lower surface of the moved pallet, so that the pallet is moved with the upper surface and the lower surface thereof in contact with the upper surface wiping means and the lower surface wiping means, whereby dirt, dust, and the like on the upper surface and the lower surface of the pallet are removed. Such a configuration is implemented by simply providing the wiping means in the feed line and does not require a special operation mechanism other than the feed line. Accordingly, pallets can be cleaned readily at low cost.

The pallet wiping device according to yet another embodiment further includes an ejection line for moving a pallet unstacked from a plurality of stacked pallets by the unstacker and placed onto the table of the lifter and for ejecting the moved pallet from the unstacker. The ejection line includes upper surface wiping means provided so as to abut on an upper surface of the pallet moved from the table to be ejected from the unstacker for cleaning the upper surface of the pallet, and lower surface wiping means provided so as to abut on a lower surface of the pallet for cleaning the lower surface of the pallet.

According to the embodiment above, an ejection line for ejecting a pallet unstacked by the unstacker is provided. The pallet is moved on this line. The upper surface wiping means and the lower surface wiping means are provided so as to abut on the upper surface and the lower surface of the moved pallet, so that the pallet is moved with the upper surface and the lower surface thereof in contact with the upper surface wiping means and the lower surface wiping means, whereby dirt, dust, and the like on the upper surface and the lower surface of the pallet are removed. Such a configuration is implemented by simply providing the wiping means in the ejection line and does not require a special operation mechanism other than the ejection line. Accordingly, pallets can be cleaned readily at low cost.

A pallet work line according to an embodiment of the present invention includes a first pallet wiping device that is the pallet wiping device as described above including an unstacker, and receives one or more stacked pallets and outputs an unstacked pallet to a subsequent stage, a work line that performs a certain procedure on the pallet output from the first pallet wiping device and outputs the pallet to a subsequent stage, and a second pallet wiping device that is the pallet wiping device as described above including a stacker, and stacks the pallet output from the work line and outputs a plurality of stacked pallets to a subsequent stage.

In the pallet work line in this embodiment, a work line is provided at a stage subsequent to the first pallet cleaning device configured to include an unstacker, so that a certain procedure can be performed on the cleaned pallet. Accordingly, the working efficiency for a certain procedure is improved. The second pallet cleaning device configured to include a stacker is provided at a stage subsequent to the work line, so that the pallet that has been subjected to a certain procedure is cleaned. Accordingly, the pallets that have been subjected to a certain procedure can be output to a subsequent stage in a state in which they are cleaned and stacked.

In the pallet work line according to another embodiment,. the wiping means of the first pallet cleaning device is formed of a material capable of absorbing a dust absorber, a dust absorber having an ability to chemically absorb dust. The wiping means of the second pallet cleaning device is formed of a water-absorbent material.

According to the embodiment above, the pallet cleaned fully enough to perform a certain procedure can be provided to the work line, and the fully cleaned pallets in a stack are output to a subsequent stage.

Advantageous Effects of Invention

According to the present invention, the washed pallet can be dried reliably at low cost.

DESCRIPTION OF EMBODIMENTS

Embodiments of a pallet wiping device, a pallet washing device, and a pallet work line according to the present invention will be described in detail below with reference to the figures. It is noted that in the figures, the same or corresponding parts are denoted with the same reference signs.

First Embodiment

Figure 1:
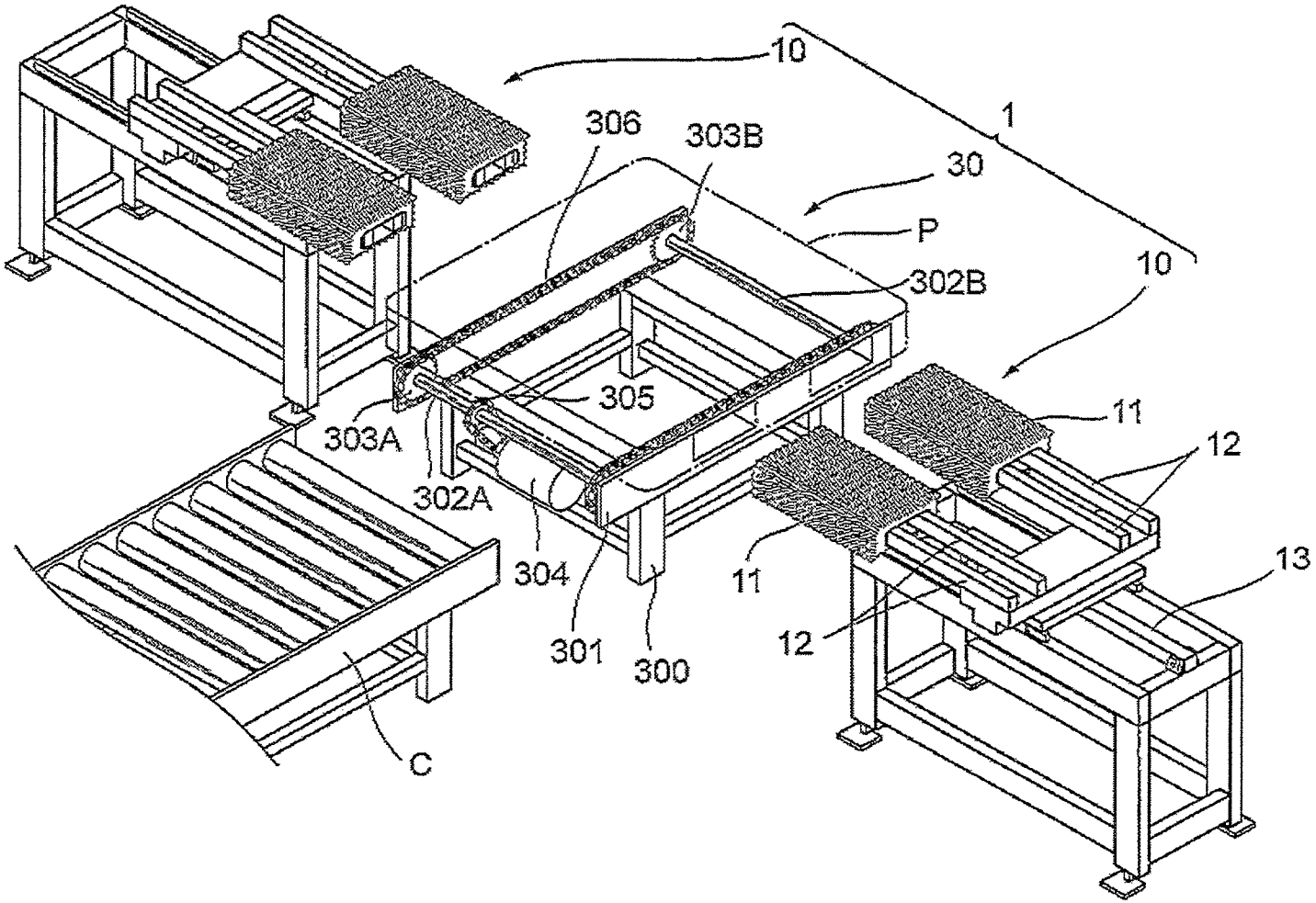
FIG. 1 is a perspective view of a pallet wiping device.

A pallet wiping device 1 in the present embodiment is shown in FIG. 1. FIG. 1 is a perspective view of the pallet wiping device 1. The pallet wiping device 1 is a device that promotes drying after washing of a pallet P having a fork insertion hole to which a fork is inserted. The pallet wiping device 1 includes a wiping unit 10 and a pallet placement unit 30, as shown in FIG. 1.

The wiping unit 10 is a unit that wipes water left in the fork insertion hole of the pallet P placed on the pallet placement unit 30. The wiping unit 10 has a water-absorbing portion 11, an arm 12, and a cylinder 13 as a power source. The detailed configuration of the wiping unit 10 will be described later with reference to FIG. 3 and FIG. 4. The pallet placement unit 30 is a unit on which a pallet P is placed.

Figure 2:
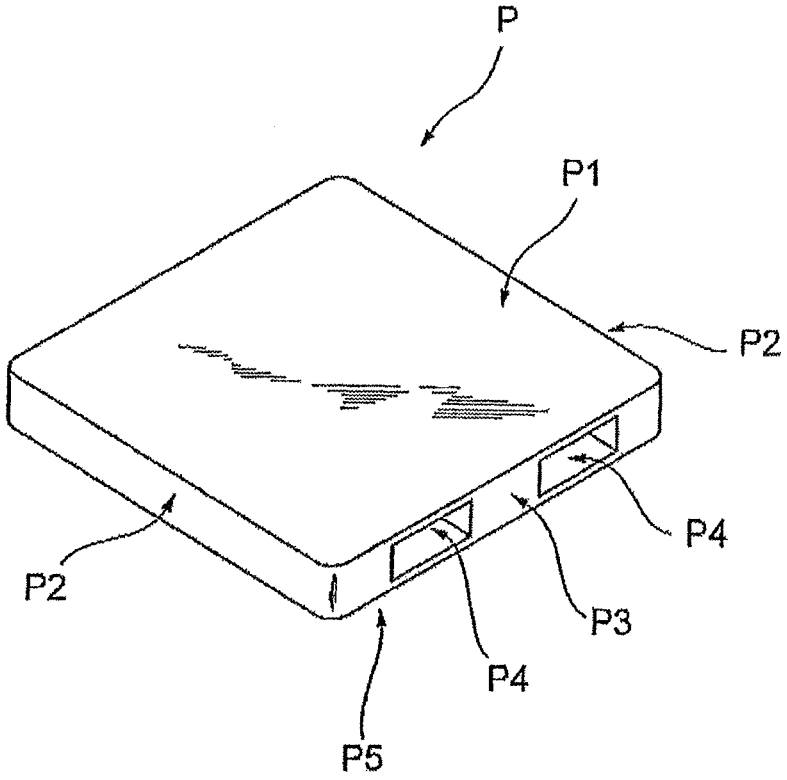
FIG. 2 is a perspective view of a pallet.

Referring now to FIG. 2, an example of a pallet P to be cleaned in the present embodiment will be described. FIG. 2 is a perspective view of a pallet P. As shown in FIG. 2, the pallet P has an upper surface P1 that forms an approximately square main surface on which a cargo is put, an approximately square lower surface P5 opposed to the upper surface P1, and two sets of opposing side surfaces P2, P3. The pallet P is also provided with fork insertion holes P4 passing through the opposing side surfaces P3. The upper surface P1 of the pallet P is formed with a deck portion on the top surface side of the pallet P. The lower surface P5 of the pallet P is formed with a deck portion on the back surface side of the pallet P.

Referring to FIG. 1 again, the configuration of the pallet placement unit 30 will be described. The pallet placement unit 30 has a base 300, a table 301, rotation shaft portions 302A and 302B, gear portions 303A and 303B, a motor 304, a drive chain 305, and a pallet feeding chain 306.

The base 300 is configured such that four pillar-like members arranged at vertices of a rectangle as viewed from above and beam members coupling the pillar-like members to each other form a frame in which the table 301 is provided.

The table 301 is provided such that a pair of rectangular plate-like members, each having a longitudinal length approximately equivalent to the length of one side of the deck portion of the pallet P, are opposed to and spaced apart from each other on the base 300. In the present embodiment, the pallet P is placed on the table 301 such that the direction in which the fork insertion hole P4 extends is orthogonal to the longitudinal direction of the table 301.

At one end and the other end of a surface of the table 301 that faces the opposing direction, the gear portions 303A and 303B that can rotate about the opposing direction are provided. The pallet feeding chain 306 is suspended between the gear portion 303A and the gear portion 303B. The opposing gear portions 303A are coupled to each other by the rotation shaft portion. 302A. The opposing gear portions 303B are coupled to each other by the rotation shaft portion 302B.

The motor 304 is provided at the base 300 to start and stop operation in accordance with an operation instruction input from a controller (not shown). The rotation shaft portion 302A is coupled through the drive chain 305 so as to be able to be driven by the motor 304. The motor 304 is operated to rotate the rotation shaft portion 302A about the opposing direction of the table 301, so that the gear portions 303A coupled to the rotation shaft portion 302A are further rotated. The pallet feeding chain 306 is then driven in the longitudinal direction of the table 301. Accordingly, when the pallet wiping device 1 is configured as part of the pallet washing device, the pallet P can be easily received from a stage previous to the pallet wiping device 1 and output to a stage subsequent to the pallet wiping device 1.

In the example shown in FIG. 1, the pallet wiping device 1 places the pallet P conveyed by a conveyor C onto the table 301. When the pallet P is placed onto the table 301, the pallet P is aligned, for example, by a stopper (not shown) provided in proximity to an end of the table 301 that is opposite to the direction in which the conveyor C is provided, as viewed from the pallet placement unit 30. This enables accurate insertion of the water-absorbing portion 11 and the arm of the wiping unit 10 into the fork insertion hole P4.

Figure 3:
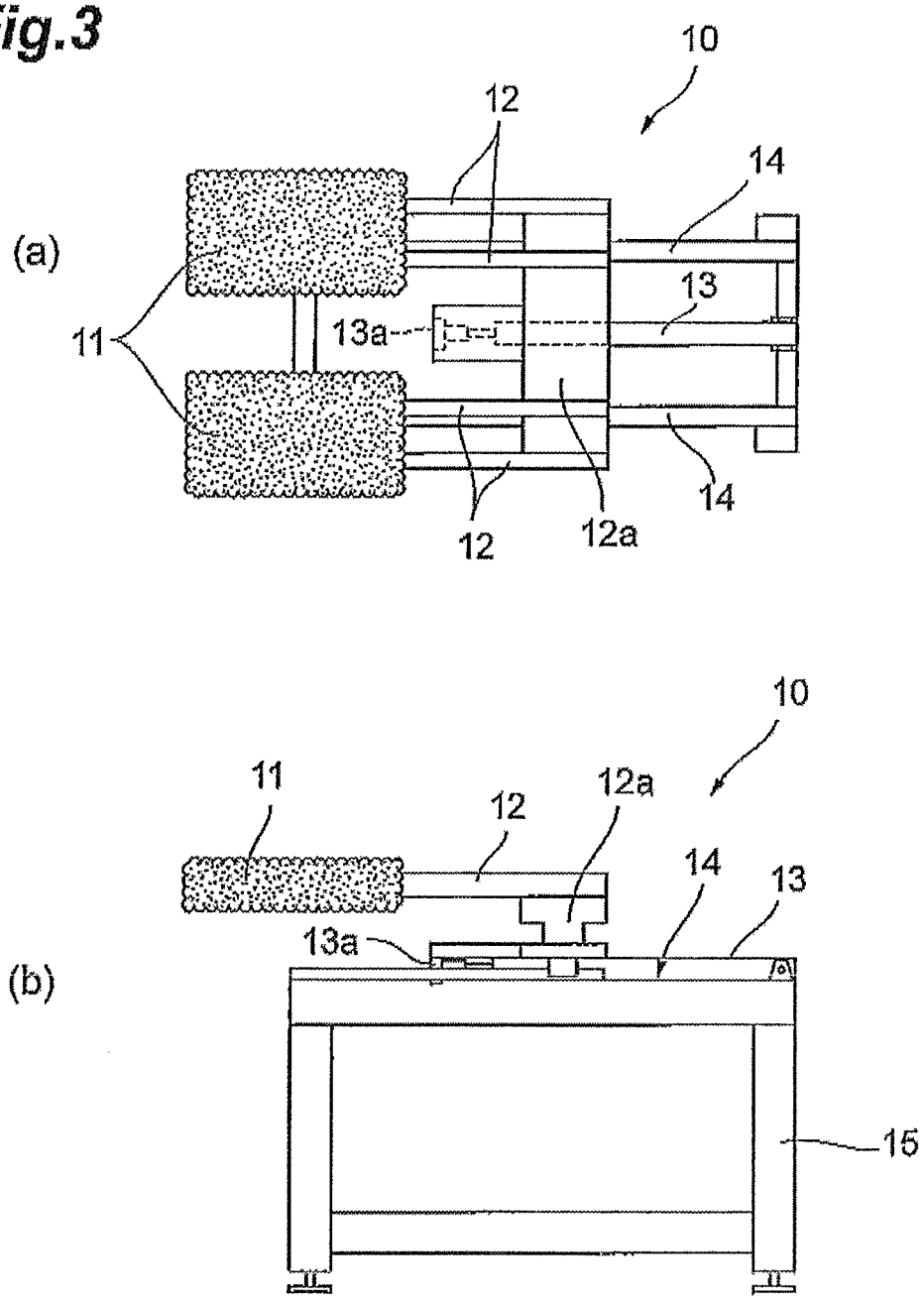
FIGS. 3A and 3B are a top view and a side view of a wiping unit of the pallet wiping device, respectively.
Figure 4:
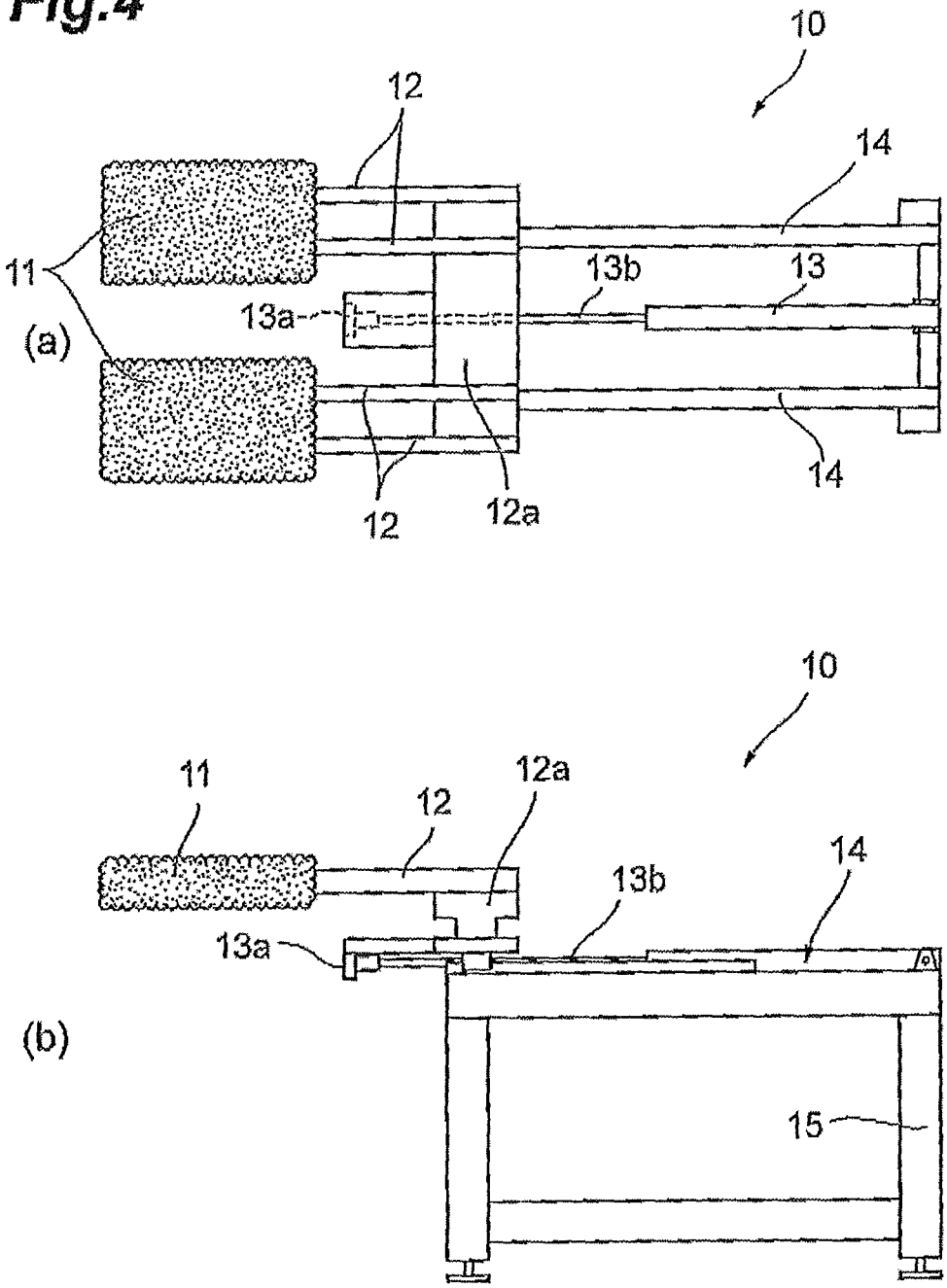
FIGS. 4A and 4B are a top view and a side view of the wiping unit of the pallet wiping device, respectively.

Referring now to FIG. 3 and FIG. 4, the detailed configuration of the wiping unit 10 will be described. FIG. 3A is a top view of the wiping unit 10 in a first state. FIG. 3B is a side view of the wiping unit 10 in the first state. FIG. 4A is a top view of the wiping unit 10 in a second state. FIG. 4B is a side view of the wiping unit 10 in the second state. The first state and the second state are states at different timings in the process of reciprocation of the arm 12. In the first state, the arm 12 is furthest from the pallet placement unit 30. In the second state, the arm 12 is closest to the pallet placement unit 30, and the water-absorbing portion 11 is inserted into the fork insertion hole P4 of the pallet P.

The wiping unit 10 has a base 15 for supporting the water-absorbing portion 11, the arm 12, and the cylinder 13. The base 15 is configured such that four pillar-like members arranged at vertices of a rectangle as viewed from above and beam members coupling the pillar-like members to each other form a frame in which the portions 11 to 14 are provided.

The wiping unit 10 has a rail 14 provided on the beam members of the base 15 and facing upward. The rail 14 is a member that guides the arm 12 such that the arm 12 reciprocates in the direction in which the fork insertion hole P4 extends. The rail 14 supports the arm 12 and is provided along the direction in which the fork insertion hole P4 extends. The arm 12 is supported on the rail 14 so as to be able to reciprocate along the direction in which the rail 14 extends.

The arm 12 is formed of a rod-like member having a cross section smaller than the size of the cross section of the fork insertion hole P4 and having a certain length. In the present embodiment, the arm 12 includes two rod-like members provided parallel to and spaced apart from each other along the direction in which the fork insertion hole P4 extends. The arm 12 in the present invention is not limited to the manner in the foregoing embodiment. The distance between the two rod-like members of the arm 12 is set to a length corresponding to the cross-sectional shape and size of the fork insertion hole P4. In the present embodiment, since the cross section of the fork insertion hole P4 has a rectangular shape having a longitudinal direction along the horizontal direction, the distance between the two rod-like members of the arm 12 corresponds to the length of the longitudinal side of the rectangular shape of the cross section of the fork insertion hole P4.

The arm 12 has the water-absorbing portion 11 supported in proximity to one end. A pair of such arms 12 are provided for one wiping unit 10 so as to be spaced apart from each other by a distance corresponding to the distance between two fork insertion holes P4 of the pallet P. The pair of arms 12 are coupled by an arm coupling member 12*a* in proximity to the other ends. The arm coupling member 12*a* is a rectangular plate-like member having a longitudinal direction set to a length corresponding to the distance between the fork insertion holes P4. The arm coupling member 12*a* is connected to a front end 13*a* of a rod 13*b* of the cylinder 13.

The cylinder 13 is a power source to move the arm 12 in a reciprocal manner along the direction in which the fork insertion hole P4 extends, while bringing the water-absorbing portion 11 into contact with the inner wall surface of the fork insertion hole P4. The cylinder 13 is provided with, for example, an air cylinder that operates pneumatically. The cylinder 13 moves the rod 13*b* reciprocally in accordance with an operation instruction input from a controller (not shown). Specifically, the arm 12 is reciprocated by the cylinder 13, so that the wiping unit 10 alternately exhibits the manner shown in FIG. 3 and the manner shown in FIG. 4.

Since the arm 12 is connected to the rod 13*b*, the cylinder 13 moves the arm 12 reciprocally along the rail 14 through the reciprocation of the rod 13*b*. In the present invention, the power source for reciprocating the arm 12 is not limited to the cylinder 13 shown in the present embodiment. The power source may be, for example, a rodless cylinder or may be any other power generator that can move the arm 12 reciprocally.

Figure 5:
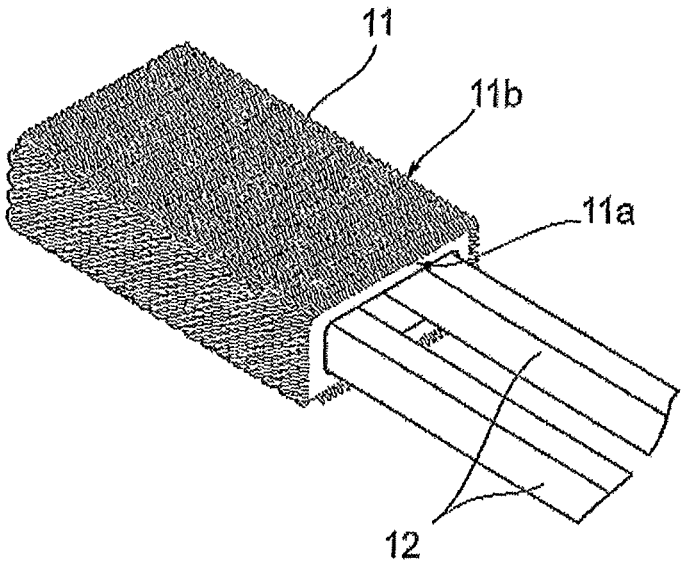
FIG. 5 is a perspective view of an arm and a water-absorbing portion.

The water-absorbing portion 11 is a portion for removing water left in the inner wall portion of the fork insertion hole P4 of the pallet P after washing and is formed of a water-absorbent material. FIG. 5 is a perspective view of the arm and the water-absorbing portion. The water-absorbing portion 11 is formed with a ground fabric 11 a made of cloth and water-absorbent pile 11*b* provided on at least one side surface of the ground fabric 11*a*. The ground fabric 11*a* is provided so as to cover one end of the arm 12. The pile 11*b* is water absorbent and therefore can absorb water left on the inner wall surface of the fork insertion hole P4. The pile 11*b* is elastic and therefore easily allows the water-absorbing portion 11 to come into intimate contact with the inner wall portion of the fork insertion hole P4 when the arm 12 reciprocates along the direction in which the fork insertion hole P4 extends. In the present embodiment, the water-absorbing portion 11 is formed with the ground fabric 11*a* and the pile 11*b*. The present invention, however, is not limited thereto. For example, the water-absorbing portion 11 may be formed of only water-absorbent cloth. In this case, the water-absorbing portion 11 can be formed at low cost.

Figure 6:
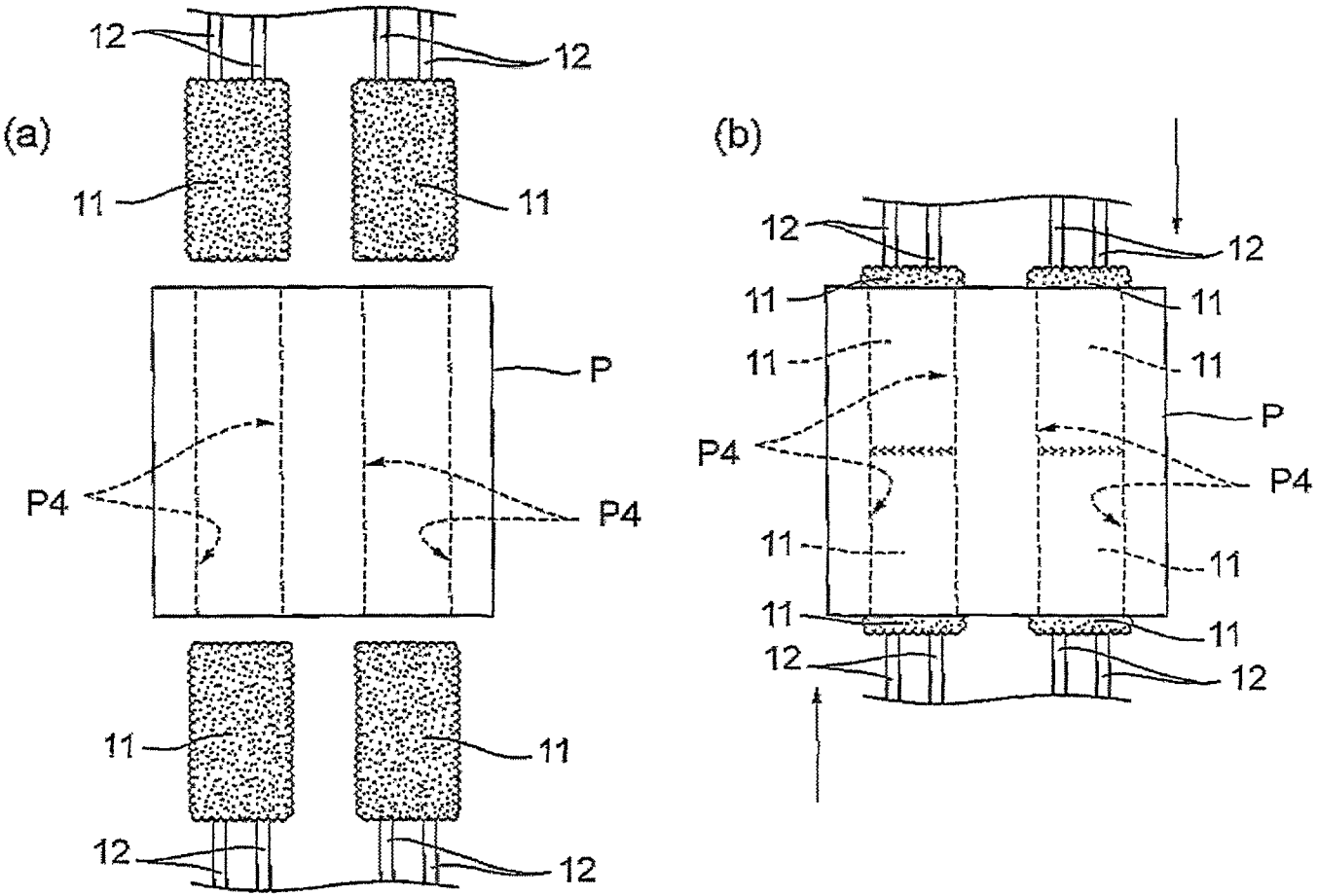
FIGS. 6A and 6B are diagrams illustrating operation of the arm and the water-absorbing portion.

Referring now to FIG. 6, the operation of the arm 12 and the water-absorbing portion 11 will be described. FIG. 6A is a diagram illustrating a state in which the arms 12 and the water-absorbing portions 11 are not inserted into the fork insertion holes P4. This state corresponds to the state shown in FIG. 3. FIG. 6B is a diagram illustrating a state in which the arms 12 and the water-absorbing portions 11 are inserted into the fork insertion holes P4. This state corresponds to the state shown in FIG. 4. Specifically, through the operation of the cylinder 13, the arms 12 and the water-absorbing portions 11 are moved from the position shown in FIG. 6A to the position shown in FIG. 6B. Through the subsequent operation of the cylinder 13, the arms 12 and the water-absorbing portions 11 are moved from the position shown in FIG. 6B to the position shown in FIG. 6A. As a result of such movements, the water-absorbing portions 11 are inserted/removed into/from the fork insertion holes P4 while coming into contact with the inner wall surfaces of the fork insertion holes P4, so that water left on the inner wall surfaces of the fork insertion holes P4 are absorbed in the water-absorbing portions 11. In order to remove water left on the inner wall surfaces of the fork insertion holes P4, the arms 12 and the water-absorbing portions 11 are reciprocated at least once.

In the case where a pair of wiping units 10 are provided along the direction in which the fork insertion hole P4 extends, with the pallet placement unit 30 interposed therebetween, as shown in FIG. 1, the arm 12 preferably has a length at least half the distance between the parallel side surfaces of the pallet P. In this case, as shown in FIG. 6B, the opposing water-absorbing portions 11 are moved to the position where the water-absorbing portions 11 come into contact with each other in proximity to the center in the direction in which the fork insertion hole P4 extends, so that the water-absorbing portions 11 can be moved in contact with the entire inner wall surfaces of the fork insertion holes P4. Accordingly, water can be removed from the entire region of the interior of the fork insertion hole P4. The operation of the cylinder 13 may be controlled such that the timings at which the opposing water-absorbing portions 11 move from the position shown in FIG. 6A to the position shown in FIG. 6B do not match. In this case, even when the accuracy of alignment of a pair of wiping units 10 is not enough, collision of the opposing water-absorbing portions 11 can be avoided.

Figure 7:
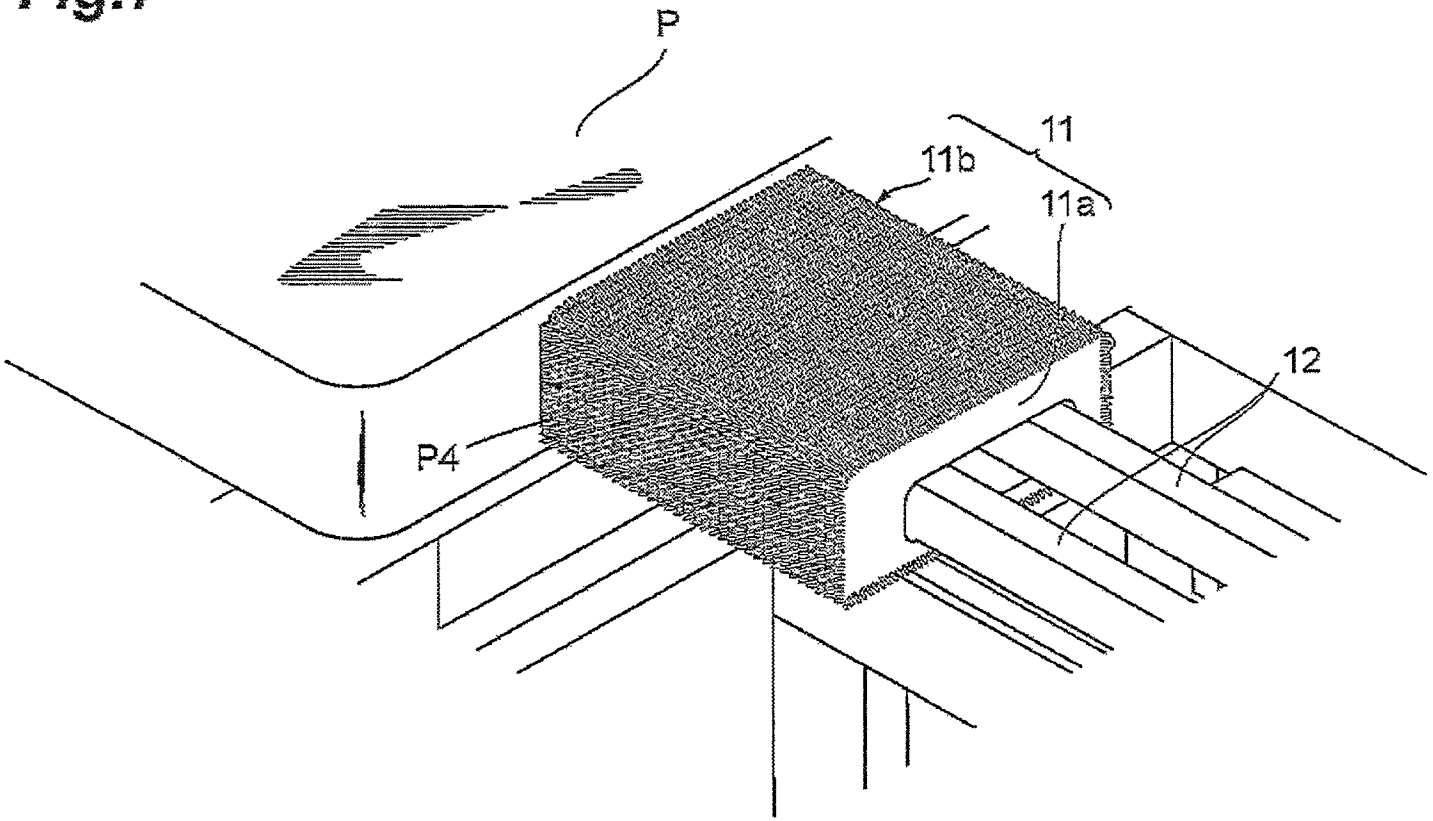
FIG. 7 is a diagram illustrating a state in which the arm and the water-absorbing portion are inserted in a fork insertion hole of a pallet.

FIG. 7 is a diagram illustrating a state in which the arm 12 and the water absorption potion 11 are inserted into the fork insertion hole P4 of the pallet P. As shown in FIG. 7, the water-absorbing portion 11 in the present embodiment is provided with the ground fabric 11 a and the pile 11*b*. The pile 11*b* is yarn having a certain thickness and length, and is water absorbent and flexible. Because of the flexibility of the pile 11*b*, even if the arm 12 that supports the water-absorbing portion 11 is not strictly aligned with the fork insertion hole P4, as long as the alignment has a certain degree of accuracy, the water-absorbing portion 11 can reciprocate with the pile 11*b* coming into contact with the inner wall surface of the fork insertion hole P4 while having the cross section changed, as viewed from the direction in which the fork insertion hole P4 extends.

Figure 8:
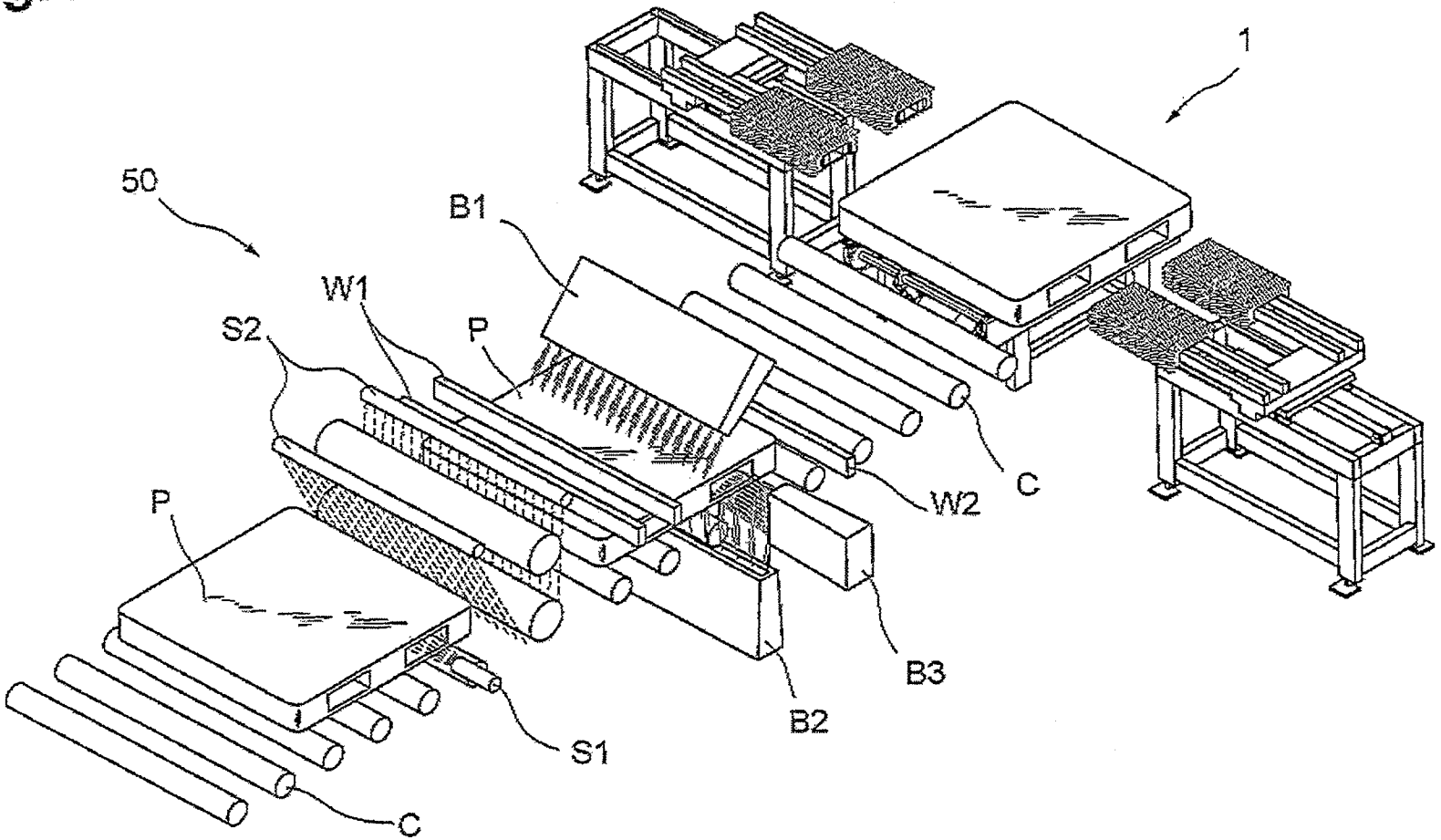
FIG. 8 is a perspective view of a pallet washing device.

A pallet washing device including the pallet wiping device 1 in the present embodiment will now be described. FIG. 8 is a perspective view of a pallet washing device 50. The pallet washing device 50 includes a side shower S1 and a mist shower S2 as washing units for washing a pallet, as shown in FIG. 8.

The side shower S1 is a device for washing the side surfaces P2 and P3 and the inside of the fork insertion holes P4 of the pallet P with water, and sprays water from the side of the pallet P. The mist shower S2 is a device for washing the deck portion of the pallet P, and sprays water from above the pallet P and removes contamination of the pallet with a brush provided at the same position.

The pallet washing device 50 also includes a top surface dewatering wiper W1, high-pressure blowers B1, B2, and B3, and a back surface dewatering wiper W2 as means for removing water left on the pallet P. The pallet washing device 50 further includes a conveyor C as a conveyance unit that conveys the pallet P from the washing unit to the water removing means and the pallet wiping device 1.

The top surface dewatering wiper W1 and the back surface dewatering wiper W2 remove water left on the deck portion on the top surface side and the deck portion on the back surface side of the pallet P. The high-pressure blowers B1, B2, and B3 are devices that remove water left on the pallet P by blowing high-pressure air to the pallet, and blow high-pressure air to the upper surface, the lower surface, and the side surface, respectively, of the pallet.

The high-pressure blower B3 is provided to remove water in the interior of the fork insertion hole P4. The high-pressure blower B3, however, cannot fully remove water in the interior of the fork insertion hole P4. In the pallet washing device 50 in the present embodiment, the pallet wiping device 1 is provided at a stage subsequent to the washing unit, so that water left in the interior of the fork insertion hole P4 can be fully removed.

At a stage subsequent to the pallet wiping device 1 in the pallet washing device 50, devices for carrying out other processes may be provided as necessary. For example, a line for checking for breakage of pallets P, a stacker as a device for piling up pallets P, and the like can be provided at a stage subsequent to the pallet wiping device 1.

As described above, in the pallet wiping device 1 in the present embodiment, the water-absorbing portion 11 supported by the arm 12 reciprocates along the direction in which the fork insertion hole P4 extends, while coming into contact with the inner wall surface of the fork insertion hole P4, whereby water left in the fork insertion hole P4 of the pallet P after washing can be removed. Accordingly, the pallet can be dried reliably. In addition, the pallet P can be dried at low cost because removal of water in the interior of the fork insertion holes P4 is implemented by wiping water with the water-absorbent water-absorbing portion 11 without using heat.

The pallet wiping device 1 in the present embodiment has a configuration in which the pallet P is placed on the pallet placement unit 30 with the upper surface P1 of the pallet P oriented approximately horizontally. The present invention, however, is not limited to this configuration. For example, the pallet wiping device 1 may have a configuration in which the pallet P is placed on the pallet placement unit 30 with the upper surface P1 of the pallet P oriented approximately vertically. In this case, a pair of arms 12 of the wiping unit 10 may be arranged to be spaced apart from each other in the approximately vertical direction in accordance with the arrangement of the fork insertion holes P4.

In the present embodiment, water left in the fork insertion hole P4 of the pallet P placed on the pallet placement unit 30 is removed. This pallet placement unit 30 may be provided with, for example, a stacker for piling up pallets P. Specifically, the pallet wiping device 1 can include a stacker in place of the pallet placement unit 30 shown in the figure, at the position where the pallet placement unit 30 in FIG. 1 is provided.

The stacker includes a pallet receiving unit and a pallet stacking unit provided above the pallet receiving unit. The pallet receiving unit is a unit that receives a pallet conveyed by the conveyor C and on which the received pallet is placed. The pallet receiving unit has a function equivalent to the pallet placement unit 30 shown in FIG. 1. Specifically, the wiping unit 10 can remove water left in the fork insertion hole P4 of the pallet P placed on the pallet receiving unit.

The pallet receiving unit has a mechanism that raises the placed pallet P to the position where the pallet stacking unit is provided, while supporting the pallet P. The pallet stacking unit has a mechanism that supports a plurality of stacked pallets. The pallet stacking unit can support the pallet raised by the pallet receiving unit and stack pallets by putting the raised pallet under the stacked pallets already supported. As described above, the pallet placement unit 30 can be configured as a stacker so that the washed and dried pallets P can be neatly stacked.

Figure 9:
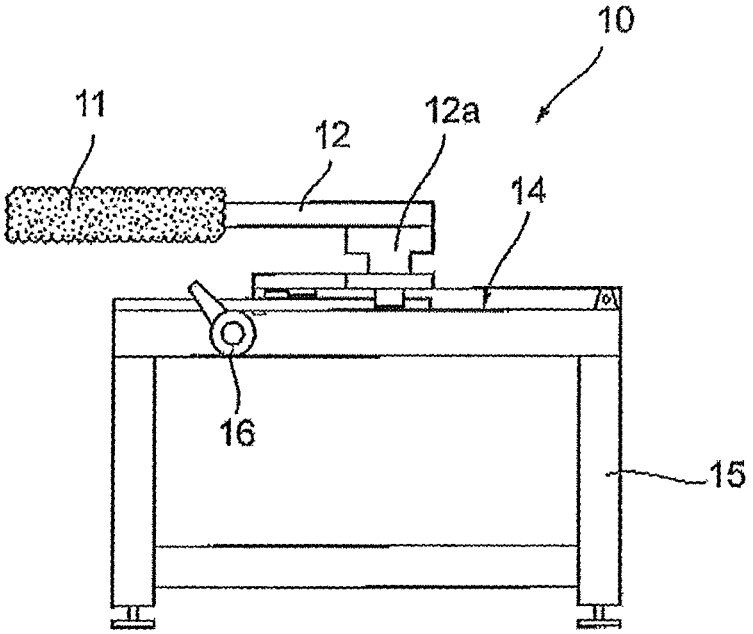
FIG. 9 is a diagram illustrating an example of the pallet wiping device with an air blowing device.

The pallet wiping device 1 in the present embodiment may further include an air blowing device for drying the water-absorbing portion 11 containing water as a result of wiping pallets. FIG. 9 is a diagram illustrating an example of the pallet wiping device with an air blowing device 16. In the example shown in FIG. 9, the wiping unit 10 includes the air blowing device 16 that outputs air toward the water-absorbing portion 11. The air blowing device 16 is coupled, for example, to the rail 14 with an air outlet facing the water-absorbing portion 11. However, the position where the air blowing device 16 is provided is not limited thereto as long as the air output from the air blowing device 16 is directed to the water-absorbing portion 11. Since a pair of arms 12 and a pair of water-absorbing portions 11 are provided corresponding to two fork insertion holes P4 of the pallet P, it is preferable that a pair of air blowing devices 16 should be provided so as to be able to output air toward a pair of water-absorbing portions 11. This air blowing device 16 is provided with a device, for example, such as a blower. As described above, the provision of the air blowing device 16 can promote evaporation of water contained in the water-absorbing portion 11 as a result of wiping pallets. Accordingly, in a case where one water-absorbing portion 11 is repeatedly used to wipe a plurality of pallets until the water absorbency is deteriorated, the number of pallets that can be wiped can be increased.

Second Embodiment

Referring to FIG. 10 to FIG. 19, an embodiment of a pallet cleaning device and a pallet work line as a second embodiment will be described in detail below.

Figure 10:
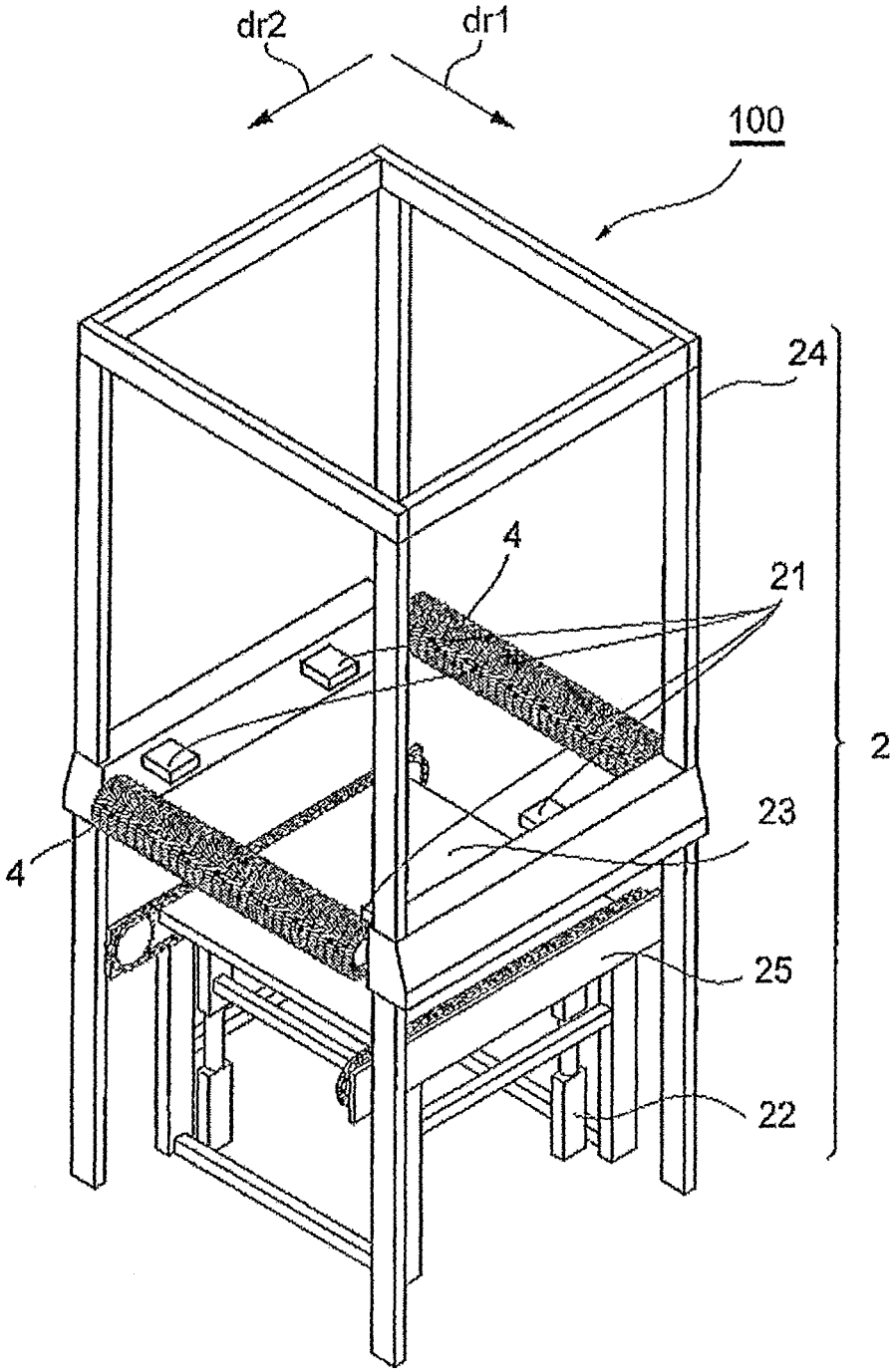
FIG. 10 is a perspective view of a pallet cleaning device.

A pallet cleaning device 100 in the present embodiment is shown in FIG. 10. FIG. 10 is a perspective view of the pallet cleaning device 100. The pallet cleaning device 100 includes a stacker/unstacker 2 and a wiping unit 4 as shown in FIG. 10. The stacker is a device that stacks pallets. The unstacker is a device that unstacks a plurality of stacked pallets one by one. The stacker and the unstacker have the same configuration and operate at different timings to implement the function as a stacker or an unstacker. Therefore, these devices are illustrated in a single drawing in FIG. 10.

The stacker and the unstacker are well-known devices in the art to which the present invention belongs. The stacker and the unstacker described in the present embodiment are illustrated as an example of devices applicable to the present invention and are not intended to exclude the application of devices other than the stacker and the unstacker shown in the present embodiment.

The stacker/unstacker 2 includes a supporter 21, a lifter 22, a frame 24, and a pallet transfer 25.

The supporter 21 is a portion that supports the bottom pallet of one or more stacked pallets at a position at a certain height.

The supporter 21 includes, for example, two sets of, four in total, rod-like members which are arranged in pairs to be opposed to each other at a position at a certain height of the frame 24 so as to extend in a first direction along the horizontal direction. The rod-like members are designed to be inserted into the four fork insertion holes of the pallet so as to support the pallet. In the stacker/unstacker 2, therefore, a pallet is arranged such that the direction in which the fork insertion hole extends is orientated along the first direction.

The rod-like members that constitute the supporter 21 are provided to be able to reciprocate between the first position and the second position along the first direction dr1 by certain drive means (not shown). The certain drive means may be, for example, a hydraulic drive mechanism, an electric drive mechanism, or any other similar mechanism. The supporter 21 is arranged and driven in the first position such that the distance between the tip ends of the opposing rod-like members is smaller than the length of one side of the upper surface of the approximately rectangular shape of a stack of pallets arranged in the stacker/unstacker 2. The supporter 21 is arranged and driven in the second position such that the distance between the tip ends of the opposing rod-like members is greater than the length of one side of the upper surface of the approximately rectangular shape of a stack of pallets arranged in the stacker/unstacker 2. The supporter 21 is arranged and driven in this manner, whereby the supporter 21 supports a stack of pallets in the first position and release support to a stack of pallets in the second position.

The lifter 22 includes a table 23 on which a pallet is placed, and has drive means (not shown) for raising/lowering the table 23 such that the pallet placed on the table 23 can be raised/lowered. This drive means may employ any driving system such as a hydraulic system and an electric system.

The frame 24 is configured, for example, such that four pillar-like members arranged at vertices of an approximately square shape as viewed from above and beam members coupling these pillar-like members to each other form a frame, as shown in FIG. 10.

The frame 24 is positioned such that, of the four beam members, a set of opposing two beam members extends in the first direction and the other set of two beam members extends in the second direction dr2 orthogonal to the first direction dr1, and is placed on the ground. The approximately square shape as viewed from above that is formed with the frame has a size large enough to receive a pallet P. The lifter 22 is provided within this frame.

In the case of the stacker, the pallet transfer 25 is a device that receives a pallet to be stacked in the frame 24 of the stacker and arranges the pallet above the table 23 of the lifter 22. In the case of the unstacker, the pallet transfer 25 is a device that discharges a pallet, unstacked and placed onto the pallet transfer 25 by the lifter 22, to the outside of the frame 24. The movement of pallets such as reception and discharge of pallets is implemented by, for example, a chain conveyor provided on the upper surface thereof. The chain conveyor is configured to be able to move the placed pallet along the second direction.

The detailed operation of the stacker/unstacker 2 will be described later with reference to FIGS. 11 to 16.

The wiping unit 4 is a unit that cleans a side surface of a pallet and is provided in the stacker/unstacker 2 so as to abut on the side surface of a pallet raised or lowered by the lifter 22. Specifically, the wiping unit 4 is provided with, for example, a core provided at the frame 24 so as to extend in the first direction dr1, and a mop covering the core. The one that covers the core is formed of any material that can clean pallets, and, for example, cloth or sponge can be applied.

In the case of the stacker, a pallet to be stacked and a stack of pallets put above the pallet to be stacked are raised by the lifter 22. In the case of the unstacker, a stack of pallets are lowered by the lifter 22. The wiping unit 4 is provided at a position where the wiping unit 4 can abut on any one of the side surfaces of the pallet raised or lowered in this manner.

In the example shown in FIG. 10, a pair of wiping units 4 are arranged to be opposed to each other so as to abut on the side surfaces orthogonal to the second direction dr2 of the bottom pallet of a stack of pallets supported by the supporter 21. The arrangement position of the wiping unit 4 is not limited to the position in contact with the bottom pallet, and may be any position where the wiping unit 4 can abut on a side surface of the pallet raised or lowered by the lifter unit 22. The arrangement position of the wiping unit 4 may be such a position where the wiping unit 4 can abut on a side surface of a pallet that is orthogonal to the first direction dr1.

The wiping unit 4 is provided at a position in contact with the pallet side surface to be cleaned while acting a certain pressure. Here, the pressure acting on the side surface of the pallet may be set in a design, considering, for example, the physical properties of the material that forms the wiping unit 4.

Figure 11:
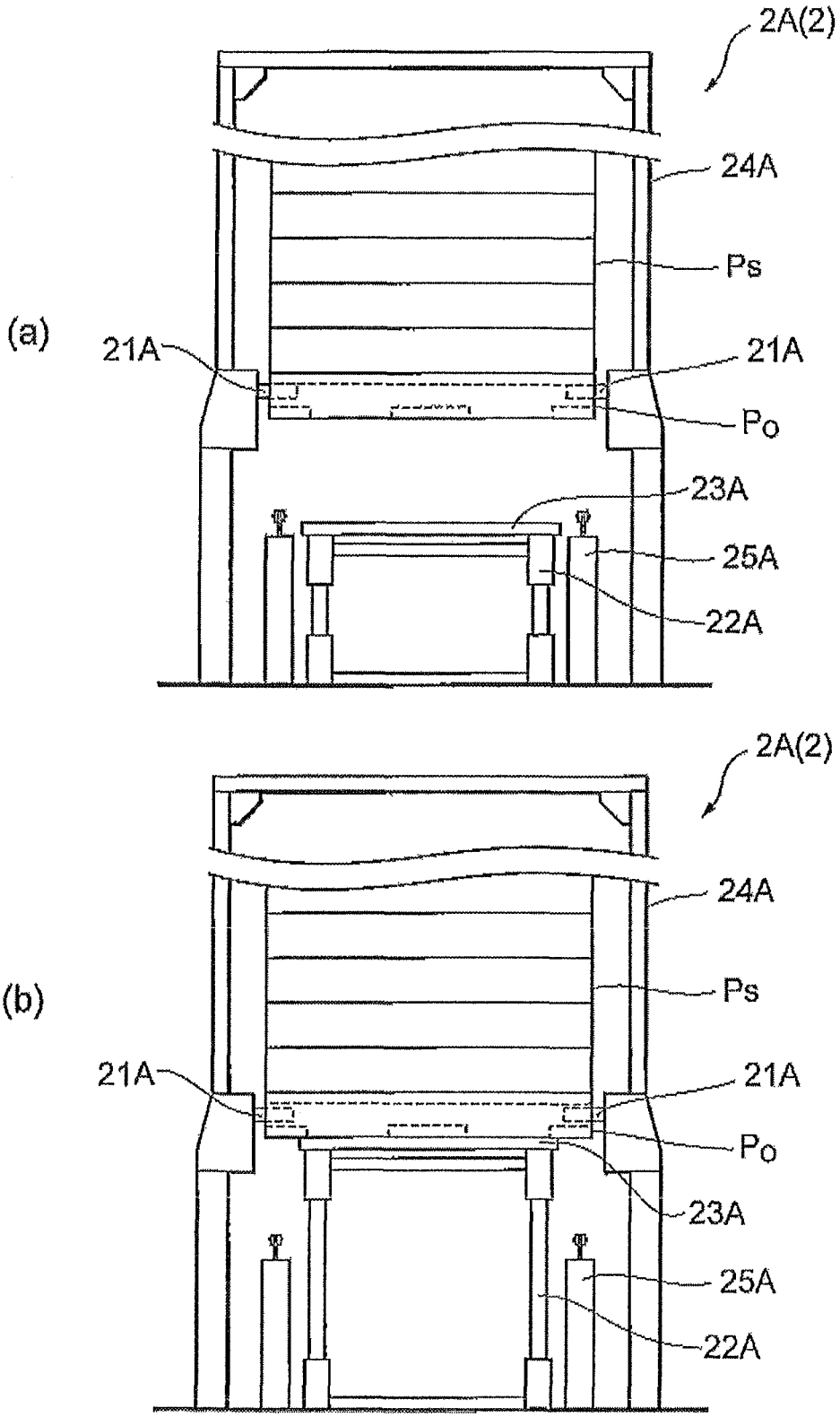
FIGS. 11A and 11B are diagrams illustrating operation of an unstacker.
Figure 12:
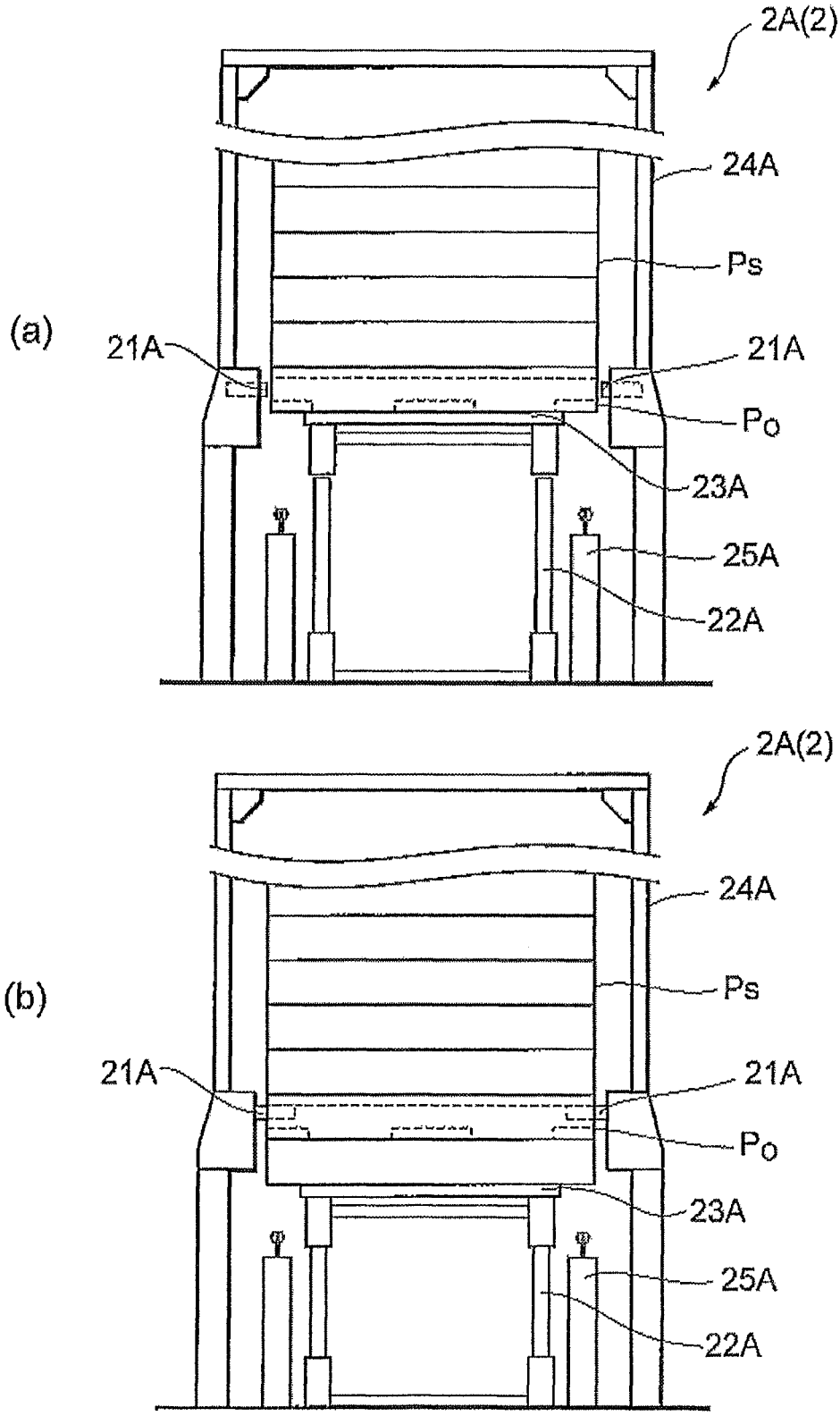
FIGS. 12A and 12B are diagrams illustrating operation of the unstacker.
Figure 13:
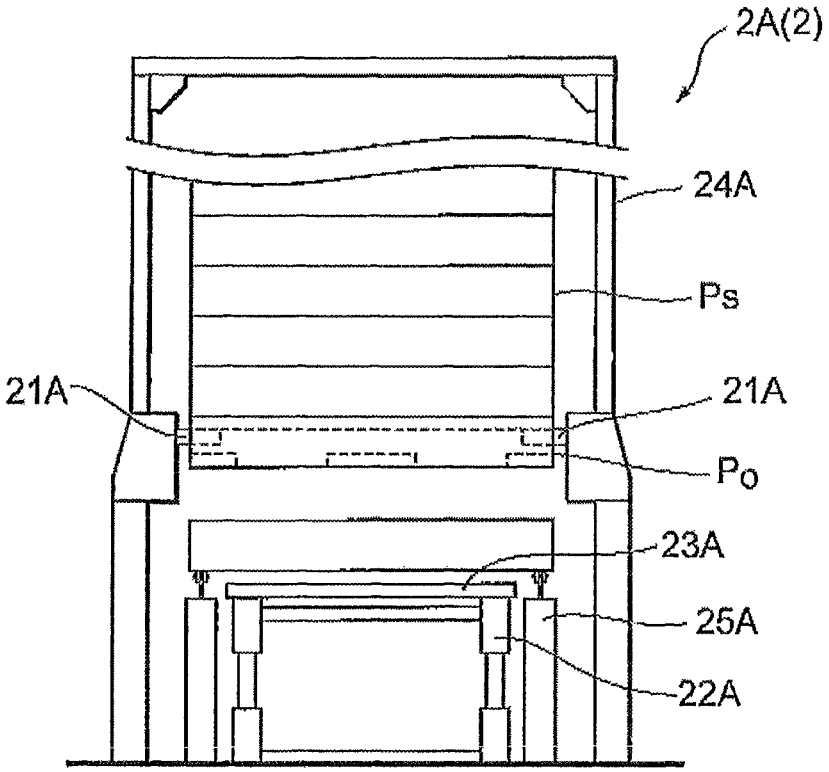
FIG. 13 is a diagram illustrating operation of the unstacker.

Referring now to FIGS. 11 to 13, the operation of an unstacker 2A that is included in the pallet cleaning device 100 in the present embodiment will be described in detail. FIGS. 11 to 13 are diagrams for explaining the operation of the unstacker and therefore do not show the wiping unit 4. FIG. 11A is a diagram illustrating a state in which a stack of pallets $P_S$ are supported by a supporter 21A. The operation of unstacking one pallet $P_O$ starting from this state is described. As shown in FIG. 11A, the supporter 21A supports the bottom pallet $P_O$ of the stack of pallets $P_S$ by positioning the rod-like members of the supporter 21A at the first position.

In the next FIG. 11B, a table 23A of a lifter 22A is raised from the state shown in FIG. 11A so that the table 23A supports the lower surface of the bottom pallet $P_O$ from below. Here, since the stack of pallets $P_S$ are raised by the table 23A from the position shown in FIG. 11A, the mass of the stack of pallets $P_S$ does not act on the supporter 21A.

Next, in FIG. 12A, the supporter 21A is moved to the second position. The stack of pallets $P_S$ become ready to be lowered, and the bottom pallet $P_O$ is released from support by the supporter 21A. In this state, as shown in FIG. 12B, the lifter 22A lowers the stack of pallets $P_S$ until a pallet $P_N$ immediately above the bottom pallet $P_O$ of the stack of pallets $P_S$ reaches a position at a certain height where the supporter 21A is provided. The supporter 21A is then moved to the first position again to support the pallet $P_N$.

As shown in FIG. 13, the lifter 22A then further lowers the pallet $P_O$ to place the pallet $P_O$ onto the pallet transfer 25A. Through the operation as described above, one pallet $P_O$ is unstacked from the stack of pallets $P_S$.

Figure 14:
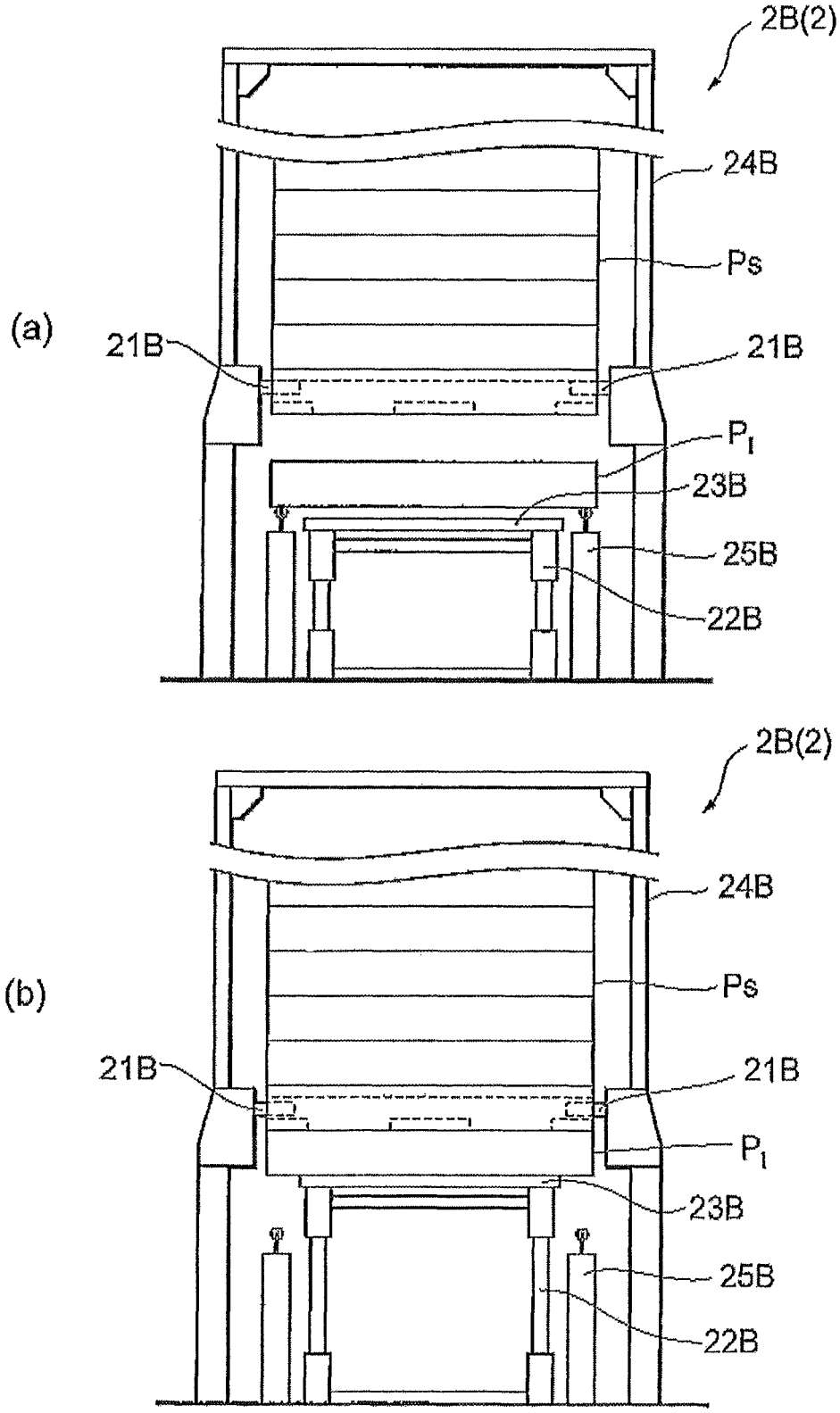
FIGS. 14A and 14B are diagrams illustrating operation of a stacker.
Figure 15:
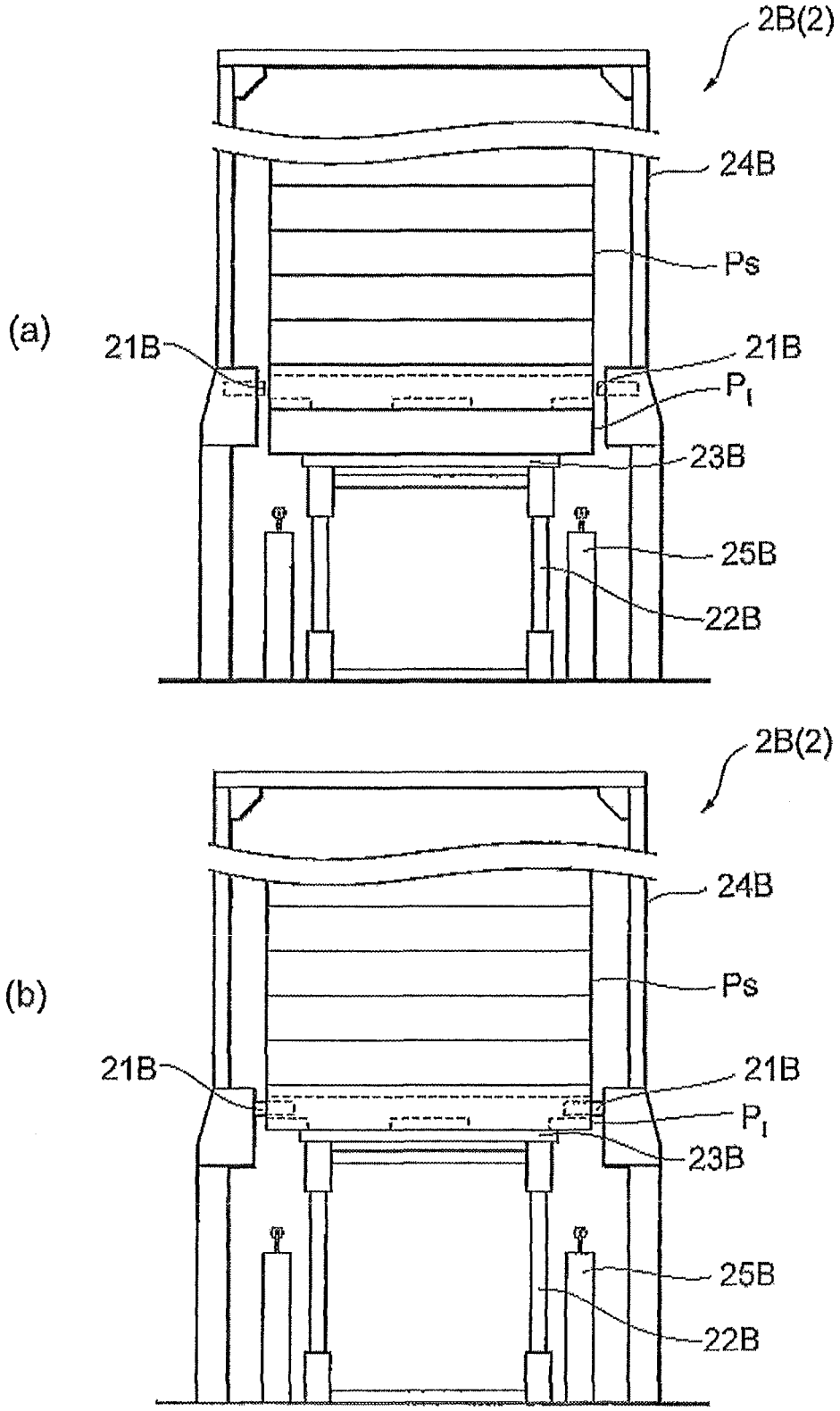
FIGS. 15A and 15B are diagrams illustrating operation of the stacker.
Figure 16:
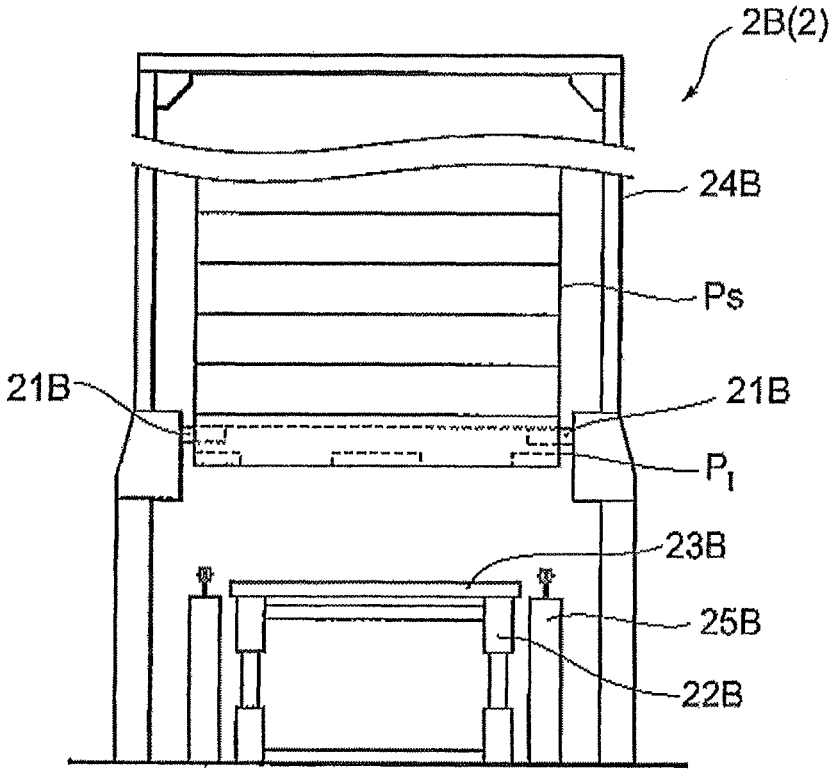
FIG. 16 is a diagram illustrating operation of the stacker.

Referring now to FIGS. 14 to 16, the operation of a stacker 2B that is included in the pallet cleaning device 100 in the present embodiment will be described in detail. FIGS. 14 to 16 are diagrams for explaining the operation of the stacker 2B and therefore do not show the wiping unit 4. FIG. 14A illustrates a state in which a stack of pallets $P_S$ are supported by a supporter 21B and a pallet $P_I$ to be stacked is placed on a pallet transfer 25B. The operation of stacking the pallet $P_I$ starting from this state is described. As shown in FIG. 14A, the supporter 21B supports the bottom pallet P of the stack of pallets $P_S$ by positioning the rod-like members of the supporter 21B at the first position.

In the next FIG. 14B, a lifter 22B raises the pallet $P_I$ to a position where the upper surface P1 of the pallet $P_I$ to be stacked comes into contact with the lower surface of the bottom pallet of the stack of pallets $P_S$, and further raises the pallet $P_I$ until the mass of the stack of pallets $P_S$ does not act on the supporter 21B.

In FIG. 15A, the supporter 21B is then moved to the second position. The stack of pallets $P_S$ then become ready to be raised. In this state, as shown in FIG. 15B, the lifter 22B raises the stack of pallets $P_S$ and the pallet $P_I$ until the pallet $P_I$ to be stacked reaches a position at a certain height where the supporter 21B is provided. The supporter 21B is then moved to the first position again to support the pallet $P_I$.

As shown in FIG. 16, the lifter 22B then lowers the table 23B, and the supporter 21B supports the pallet $P_I$ together with the pallets $P_S$. Through the operation as described above, the pallet $P_I$ is stacked.

Figure 17:
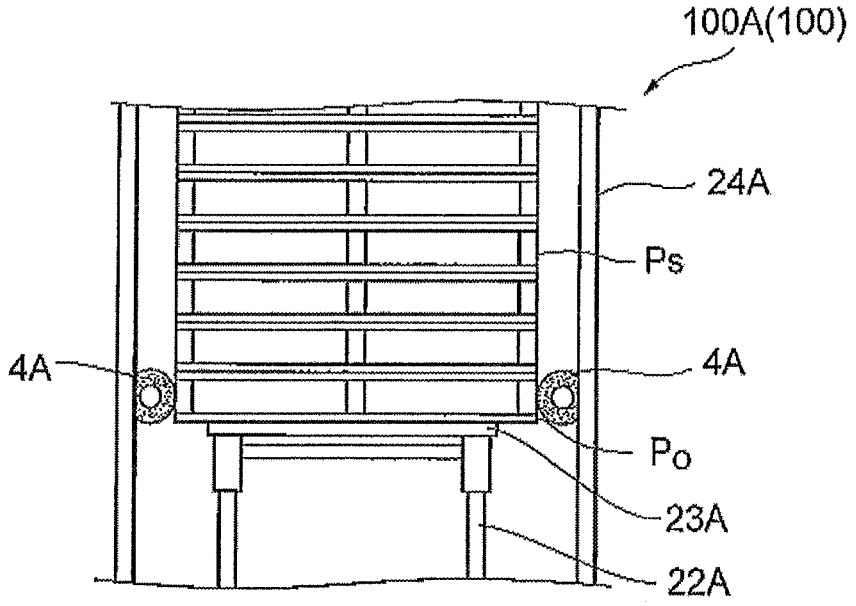
FIGS. 17A and 17B are diagrams illustrating cleaning of a pallet in a pallet cleaning device including the unstacker.
Figure 17:
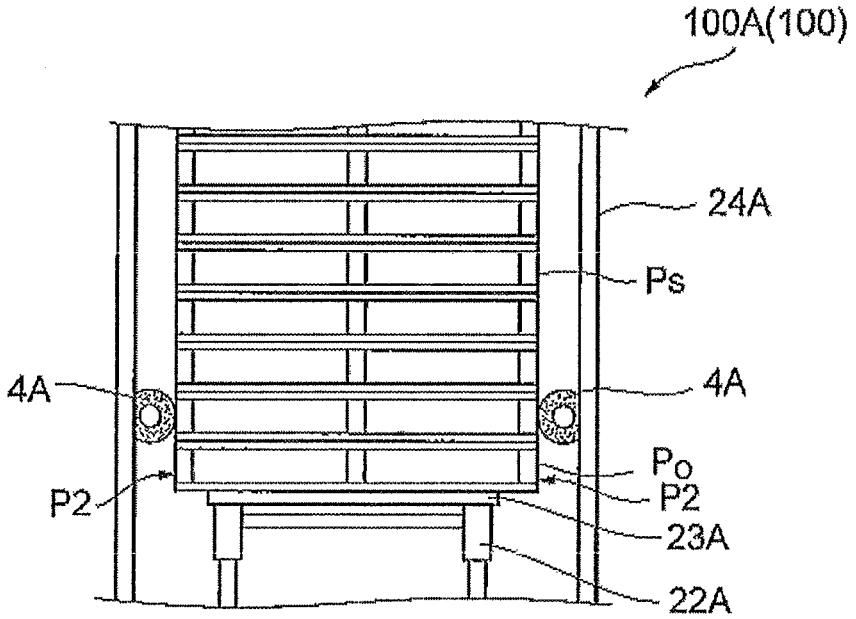

Referring now to FIG. 17, cleaning of pallets in a pallet cleaning device 100A including the unstacker 2A will be described. FIG. 17A is a diagram illustrating a state of pallets P and the lifter 22A when the unstacker 2A is in a state shown in FIG. 11B. FIG. 17B is a diagram illustrating a state of pallets P and the lifter 22A when the unstacker 2A is in a state shown in FIG. 12B.

When the unstacker 2A changes from the state shown in FIG. 17A to the state shown in FIG. 17B, the table 23A of the lifter 22A is lowered, whereby the bottom pallet $P_O$ of the stack of pallets is lowered with the side surfaces P2 coming into contact with wiping units 4A.

Accordingly, contamination such as dirt and dust on the side surfaces P2 of the pallet $P_O$ is cleaned by the wiping units 4A.

Figure 18:
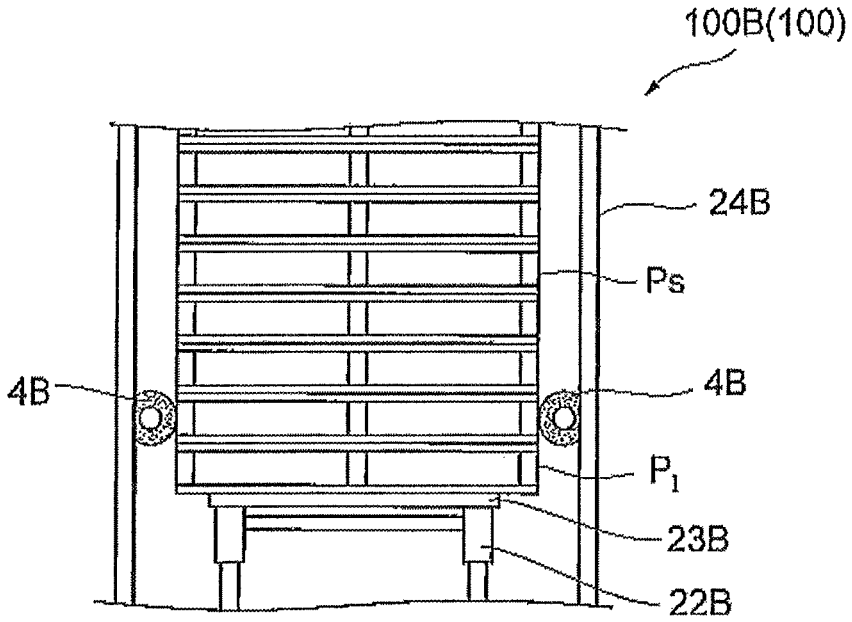
FIGS. 18A and 18B are diagrams illustrating cleaning of a pallet in a pallet cleaning device including the stacker.
Figure 18:
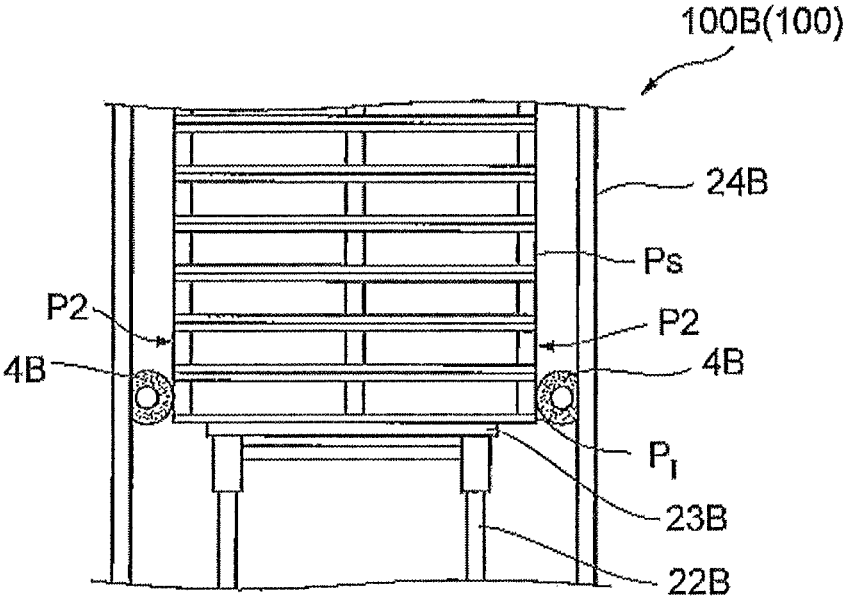

Referring now to FIG. 18, cleaning of pallets in a pallet cleaning device 100B including the stacker 2B will be described. FIG. 18A is a diagram illustrating a state of pallets P and the lifter 22B when the stacker 2B is in the state shown in FIG. 14B. FIG. 18B is a diagram illustrating a state of pallets P and the lifter 22B when the stacker 2B is in the state shown in FIG. 15B.

When the stacker 2B changes from the state shown in FIG. 18A to the state shown in FIG. 18B, the table 23B of the lifter 22B is raised, whereby the bottom pallet P of the stack of pallets is raised with the side surfaces P2 coming into contact with wiping units 4B. Accordingly, contamination such as dirt and dust on the side surfaces P2 of the bottom pallet P of the stack of pallets is cleaned by the wiping units 4B.

Figure 19:
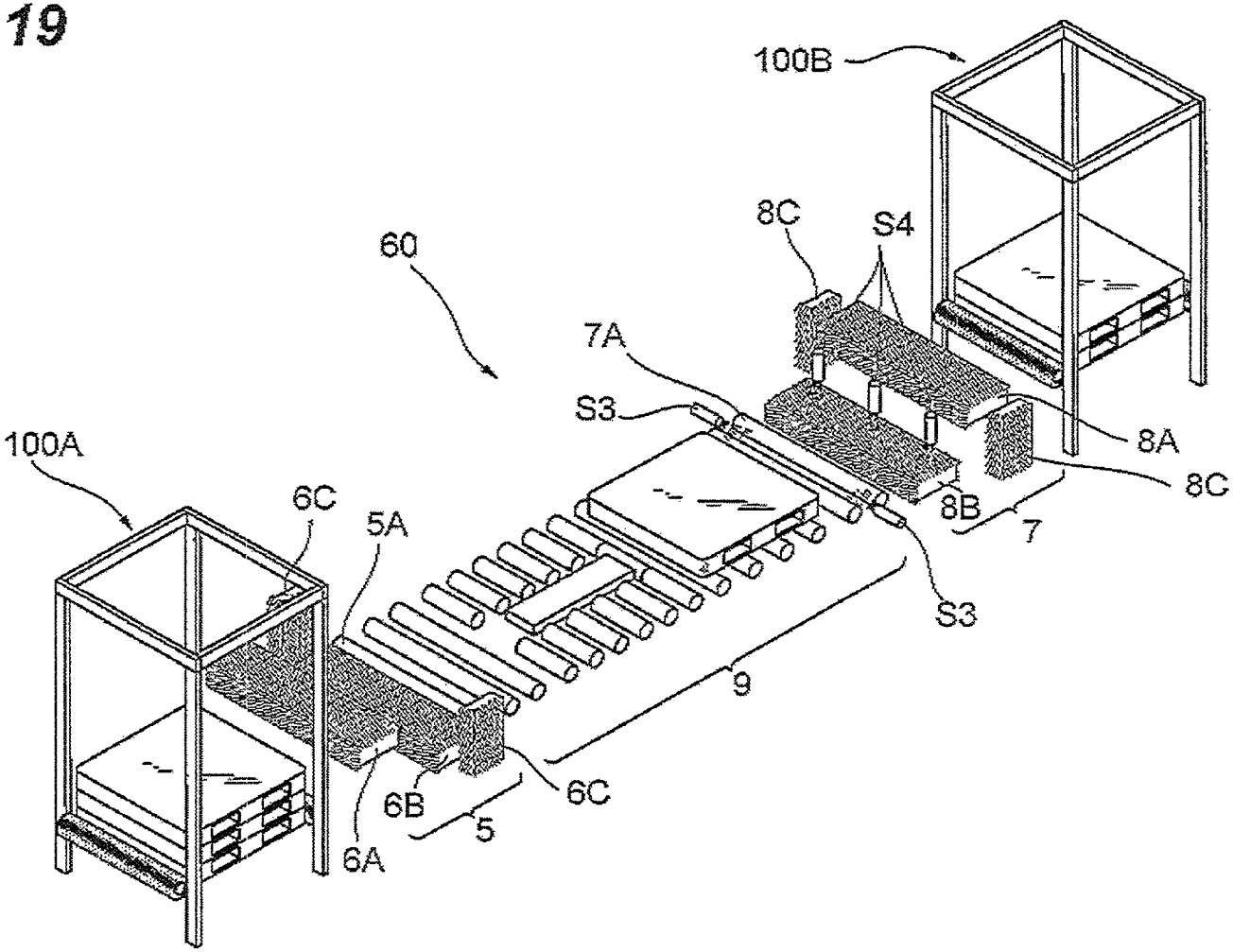
FIG. 19 is a schematic diagram illustrating a pallet work line.

A pallet work line including the pallet cleaning device 100 in the present embodiment will now be described. FIG. 19 is a schematic diagram illustrating a pallet work line 60. The pallet work line 60 includes the pallet cleaning device 100A with the unstacker 2A and the pallet cleaning device 100B with a work line 9 and the stacker 2B, as illustrated in FIG. 19.

The pallet cleaning device 100A can include an ejection line 5 as shown in FIG. 19. The ejection line 5 is a line for moving a pallet unstacked from a stack of pallets and placed onto the pallet transfer 25A and for ejecting the moved pallet from the unstacker 2A. The ejection line 5 can include a conveyor 5A that operates by a certain power source. The ejection line 5 can eject a pallet with this conveyor 5A.

The ejection line 5 also has an upper surface wiper 6A provided so as to abut on the upper surface P1 of the pallet P ejected from the unstacker 2A and moved for cleaning the upper surface of the pallet, and a lower surface wiper 6B provided so as to abut on the lower surface P5 of the pallet for cleaning the lower surface P5 of the pallet. The ejection line 5 can further have side surface wipers 6C provided so as to abut on the side surfaces P3 of the pallet for cleaning the side surfaces of the pallet.

The upper surface wiper 6A, the lower surface wiper 6B, and the side surface wipers 6C may be formed of any material that can clean pallets in the same manner as in the wiping unit 4A and can be formed, for example, of a mop, cloth, or sponge. Accordingly, dirt, dust, and the like, on the upper surface P1, the lower surface P5, and the side surfaces P3 of a pallet can be removed without requiring a special operation mechanism other than the mechanism for moving the pallet in the ejection line.

The pallet cleaning device 100B can include a feed line 7 as shown in FIG. 19. The feed line 7 is a line for moving a pallet P to be stacked and feeding the pallet into the stacker 2B. The feed line 7 can include a conveyor 7A that operates by a certain power source. The feed line 7 can feed a pallet into the stacker 2B with this conveyor 7A.

The feed line 7 also has an upper surface wiper 8A provided so as to abut on the upper surface P1 of the pallet P moved to be fed into the stacker 2B for cleaning the upper surface of the pallet, and a lower surface wiper 8B provided so as to abut on the lower surface P5 of the pallet for cleaning the lower surface P5 of the pallet. The feed line 7 can further have side surface wipers 8C provided so as to abut on the side surfaces P3 of the pallet for cleaning the side surfaces of the pallet.

The upper surface wiper 8A, the lower surface wiper 8B, and the side surface wipers 8C may be formed of any material that can clean pallets in the same manner as in the wiping unit 4B and can be formed, for example, of a mop, cloth, or sponge. Accordingly, dirt, dust, and the like on the upper surface P1, the lower surface P5, and the side surfaces P3 of a pallet can be removed without requiring a special operation mechanism other than the mechanism for moving the pallet in the feed line 7.

The feed line 7 can further have sprays S3 and S4 for maintaining the moisture of the surface of pallet P for the purpose of enhancing the cleaning effect, as shown in FIG. 19. The sprays S3 and S4 spray, for example, water to the surface of pallet P. The sprays S3 and S4 may spray not only water but also a liquid detergent, for example, to the pallet.

The work line 9 is a line for performing a certain procedure on the pallet output from the pallet cleaning device 100A and outputting the pallet to the pallet cleaning device 100B. The procedure performed on the pallet P in the work line 9 includes, for example, checking whether breakage occurs by visual inspection.

The wiping unit 4A in the pallet cleaning device 100A is formed of, for example, a material capable of absorbing a dust absorber having the ability to chemically absorb dust. upper surface wiper 6A, the lower surface wiper 6B, and the side surface wipers 6C may also be formed of a material capable of absorbing a dust absorber having the ability to chemically absorb dust. Accordingly, the pallet cleaned fully enough to perform a certain procedure can be provided to the work line.

The wiping unit 4B in the pallet cleaning device 100B is formed of, for example, a water-absorbent material. For example, the wiping unit 4B can be provided with a mop containing water adequately, so that the pallet P can be fully cleaned in the pallet cleaning device 100B. The upper surface wiper 8A, the lower surface wiper 8B, and the side surface wipers 8C may also be formed of a water-absorbent material. Accordingly, the pallet can be fully cleaned in the feed line 7.

As described above, the pallet cleaning device 100B in the present embodiment includes the stacker 2B for stacking pallets P. In the stacker 2B, a stack of pallets P are raised in a state the pallets P are put on a pallet P to be stacked. The wiping unit 4B is provided so as to abut on a side surface of the raised pallets P. Therefore, the pallet side surface is raised in contact with the wiping unit 4B whereby dirt, dust, and the like on the side surface of the pallet P is removed. This configuration is implemented by simply providing the wiping unit 4B in the stacker 2B and does not require a special operation mechanism other than the stacker 2B. Pallets therefore can be cleaned readily at low cost.

The pallet cleaning device 100A in the present embodiment includes the unstacker 2A for unstacking a stack of pallets P. In this unstacker 2A, when the bottom pallet P of a stack of pallets P is unstacked, the stack of pallets P are lowered by the lifter 22A. The wiping unit 4A is provided so as to abut on a side surface of the lowered pallet. Therefore, the side surface of the pallet is lowered in contact with the wiping unit 4A whereby dirt, dust, and the like on the side surface of the pallet is removed. This configuration is implemented by simply providing the wiping unit 4A in the unstacker 2A and does not require a special operation mechanism other than the unstacker 2A. Pallets therefore can be cleaned readily at low cost.

Third Embodiment

Figure 20:
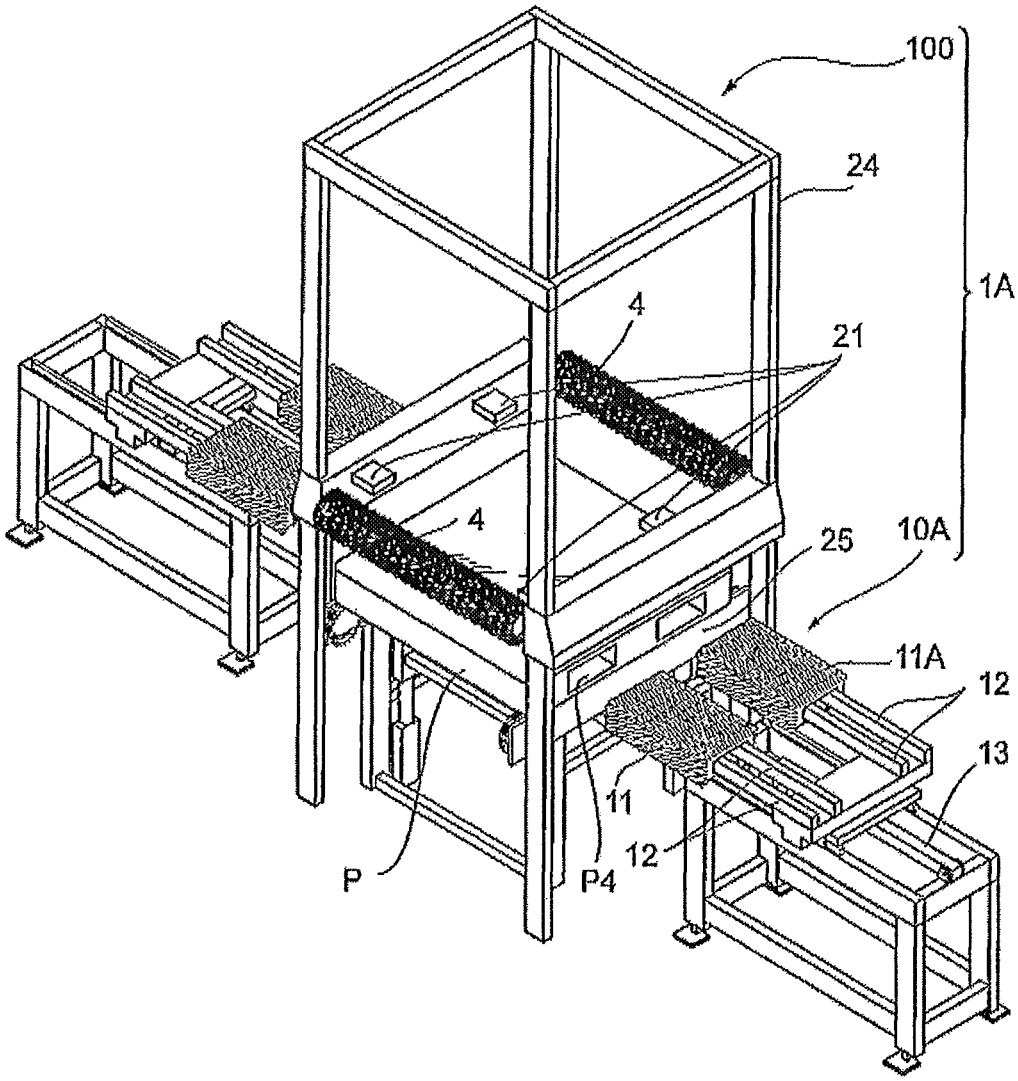
FIG. 20 is a perspective view of a pallet wiping device including a configuration of part of the pallet cleaning device.
Figure 21:
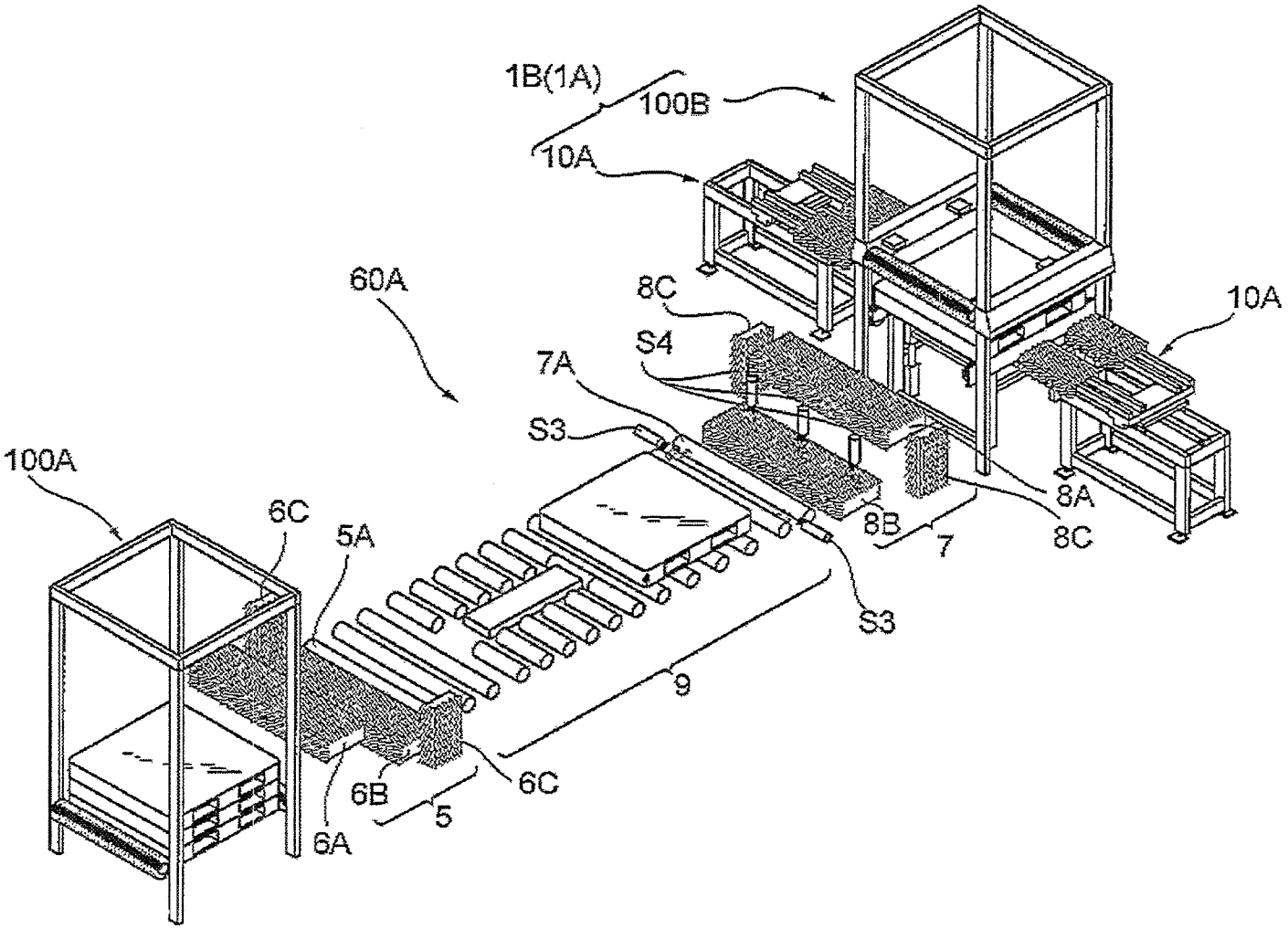
FIG. 21 is a schematic diagram illustrating a pallet work line including the pallet wiping device shown in FIG. 20.

Referring now to FIG. 20 to FIG. 21, an embodiment of a pallet wiping device and a pallet work line as a third embodiment will be described in detail below.

A pallet wiping device 1A in the present embodiment is shown in FIG. 20. FIG. 20 is a perspective view of the pallet wiping device 1A.

As shown in FIG. 20, the pallet wiping device 1A includes a wiping unit 10A and the pallet cleaning device 100.

Specifically, the pallet wiping device 1A includes the pallet cleaning device 100 in the second embodiment in place of the pallet placement unit 30 of the pallet wiping device 1 in the first embodiment described with reference to FIG. 1.

In the third embodiment, the pallet cleaning device 100 is included in the pallet placement unit on which a pallet P is placed such that the direction in which the fork insertion hole P4 of the pallet P extends is orientated along a certain direction. The wiping unit 10A can clean the interior of the fork insertion hole P4 and wipe water left in the interior of the fork insertion hole P4 of the pallet P placed on the pallet transfer 25 of the pallet cleaning device 100. The wiping unit 10A has a cleaning/water-absorbing portion 11A, an arm 12, and a cylinder 13 as a power source. The cleaning/water-absorbing portion 11A cleans the interior of the fork insertion hole P4 of the pallet P. The cleaning/water-absorbing portion 11A also wipes water left in the interior of the fork insertion hole P4. Specifically, the wiping unit 10A is aligned with the pallet cleaning device 100 such that the arm 12 reciprocates along the direction in which the fork insertion hole P4 extends, while the cleaning/water-absorbing portion 11A is brought into contact with the inner wall surface of the fork insertion hole P4 of the pallet P placed on the pallet transfer 25 of the stacker/unstacker 2 included in the pallet cleaning device 100.

In the pallet wiping device in the present embodiment, the cleaning/water-absorbing portion 11A supported by the arm 12 reciprocates along the direction in which the fork insertion hole P4 extends, while coming into contact with the inner wall surface of the fork insertion hole P4, whereby the interior of the fork insertion hole P4 of the pallet P can be cleaned and water left therein can be removed. In addition, the wiping unit 4 provided in the stacker 2B or the unstacker 2A so as to abut on a side surface of the pallet can remove dirt, dust, and the like on the side surface of the raised or lowered pallet.

FIG. 21 is a schematic diagram illustrating a pallet work line 60A in the present embodiment. As shown in FIG. 21, the pallet work line 60A includes a pallet wiping device 1B (1A) in place of the pallet cleaning device 100B in the pallet work line 60 in the second embodiment described with reference to FIG. 19. The pallet wiping device 1B includes the pallet cleaning device 100B configured to include the stacker 2B and the wiping unit 10A.

The pallet work line 60A has the pallet cleaning device 100A at a stage previous to the ejection line 5 in FIG. 21, in the same manner as in the second embodiment, but instead may include the pallet wiping device 1 including the pallet cleaning device 100A configured to include the unstacker 2A and the wiping unit 10A.

In the pallet work line 60A in the present embodiment, a work line can be provided at a stage subsequent to the pallet wiping device 1 configured to include the unstacker, so that a certain procedure can be performed on the cleaned pallet. This improves the working efficiency for a certain procedure. Since the pallet wiping device 113 configured to include the stacker is provided at a stage subsequent to the work line, the pallet that has been subjected to a certain procedure can be cleaned and dried. Accordingly, the pallets that have been subjected to a certain procedure can be output to a subsequent stage in a state in which they are cleaned and stacked.

INDUSTRIAL APPLICABILITY

As described above, the present embodiment provides a pallet wiping device capable of drying the washed pallet reliably at low costs.

REFERENCE SIGNS LIST

1, 1A, 1B . . . pallet wiping device, 2 . . . stacker/unstacker, 2A . . . unstacker, 2B . . . stacker, 4, 4A, 4B . . . wiping unit, 5 . . . ejection line, 5A . . . conveyor, 6A . . . upper surface wiper, 6B . lower surface wiper, 6C . . . side surface wiper, 7 . . . feed line, 7A . . . conveyor, 8A . . . upper surface wiper, 8B . . . lower surface wiper, 8C . . . side surface wiper, 9 . . . work line, 10, 10A . . . wiping unit, 11 . . . water-absorbing portion, 11 A . . . cleaning/water-absorbing portion, 11*a* . . . ground fabric, 11*b* . . . pile, 12 . . . arm, 12*a* . . . arm coupling member, 13 . . . cylinder, 13*a* . . . tip end, 13*b* . . . rod, 14 . . . rail, 15 . . . base, 16 . . . air blowing device, 21, 21A, 21B . . . supporter, 22, 22A, 22B . . . lifter, 23, 23A, 23B . . . table, 24 . . . frame, 25, 25A, 25B . . . pallet transfer, 30 . . . pallet placement unit, 50 . . . pallet washing device, 60, 60A . . . pallet work line, 100, 100A, 100B . . . pallet cleaning device, P, $P_I$, $P_N$, $P_O$, $P_S$ . . . pallet, P4 . . . fork insertion hole.

The invention claimed is:

1. A pallet wiping device that promotes drying after washing of a pallet including a fork insertion hole to which a fork is inserted, the pallet wiping device comprising:

a wiping unit including a water-absorbing portion, an arm, and a power source; and a pallet placement unit on which the pallet is placed at a certain position such that a direction in which the fork insertion hole extends is oriented along a certain direction, wherein the water-absorbing portion is formed of a water-absorbent material, the arm supports the water-absorbing portion and is connected to the power source, and the power source moves the arm reciprocally along the certain direction while bringing the water-absorbing portion into contact with an inner wall surface of the fork insertion hole of the pallet placed on the pallet placement unit.

2. The pallet wiping device according to claim 1, wherein the wiping unit further includes a rail that supports the arm and is provided along the certain direction, and the arm is formed with a rod-like member having a cross section smaller than a size of a cross section of the fork insertion hole and having a certain length, supports the water-absorbing portion in proximity to one end, and reciprocates along the rail.

3. The pallet wiping device according to claim 2, wherein the wiping unit has a pair of such arms spaced apart from each other by a distance corresponding to a distance between two fork insertion holes of the pallet, the pair of arms are connected by an arm coupling portion in proximity to the other ends, the arm coupling member is connected to the power source, and the power source moves the arm coupling member reciprocally along the certain direction.

4. The pallet wiping device according to claim 1, wherein the fork insertion hole is provided so as to pass through between parallel side surfaces of the pallet, a pair of such wiping units are arranged along the certain direction so that the pallet placement unit is interposed therebetween, and the arm has a length at least half a distance between the parallel side surfaces of the pallet.

5. The pallet wiping device according to claim 1, wherein the water-absorbing portion is formed with a ground fabric made of cloth and water-absorbent pile provided at least one side surface of the ground fabric, and the ground fabric is provided so as to cover one end of the arm.

6. The pallet wiping device according to claim 1, wherein the water-absorbing portion is made of cloth, and the water-absorbing portion is provided so as to cover one end of the arm.

7. The pallet wiping device according to claim 1, wherein the pallet placement unit is provided with a stacker that is a device for stacking pallets.

8. The pallet wiping device according to claim 1, wherein the wiping unit further includes an air blowing device that outputs air toward the water-absorbing portion.

9. A pallet washing device for washing a pallet, comprising:

a washing unit that washes a pallet with water;

the pallet wiping device of claim 1 provided at a stage subsequent to the washing unit; and a conveyance unit that conveys a pallet washed in the washing unit to the pallet placement unit of the pallet wiping device.

10. The pallet wiping device according to claim 1, further comprising:

a stacker that stacks pallets, the stacker including a supporter that supports a bottom pallet of one or more stacked pallets at a position at a certain height, and a lifter including a table on which a pallet to be stacked is placed, the lifter being capable of raising and lowering the pallet to be stacked with the pallet being placed on the table; and wiping means provided in the stacker so as to abut on a side surface of a pallet raised by the lifter for cleaning the side surface of the pallet, wherein the lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height, the supporter supports the pallet to be stacked that is raised by the lifter, at the position at a certain height, and the table of the lifter is included in the pallet placement unit.

11. The pallet wiping device according to claim 1, further comprising:

an unstacker that unstacks a plurality of stacked pallets one by one, the unstacker including a supporter that supports a bottom pallet of one or more stacked pallets at a position at a certain height, and a lifter including a table on which a pallet is placed, the lifter being capable of raising and lowering a pallet with the pallet being placed on the table; and wiping means provided in the unstacker so as to abut on a side surface of a pallet lowered by the lifter for cleaning the side surface of the pallet, wherein the supporter releases support to the bottom pallet in a state in which the lifter supports a lower surface of the bottom pallet from below with the table, the lifter lowers the stacked pallets until a pallet immediately above the bottom pallet of the stacked pallets reaches the position at a certain height, the supporter supports the pallet immediately above the bottom pallet, the lifter lowers the bottom pallet to a certain position with the bottom pallet being placed on the table, and the table of the lifter is included in the pallet placement unit.

12. The pallet wiping device according to claim 10, further comprising a feed line at the table in the lifter of the stacker for moving a pallet to be stacked and placing the moved pallet onto the table, wherein the feed line includes upper surface wiping means provided so as to abut on an upper surface of the pallet moved to the table for cleaning the upper surface of the pallet, and lower surface wiping means provided so as abut on a lower surface of the pallet for cleaning the lower surface of the pallet.

13. The pallet wiping device according to claim 11, further comprising an ejection line for moving a pallet unstacked from a plurality of stacked pallets by the unstacker and placed onto the table of the lifter and for ejecting the moved pallet from the unstacker, wherein the ejection line has upper surface wiping means provided so as to abut on an upper surface of the pallet moved from the table to be ejected from the unstacker for cleaning the upper surface of the pallet, and lower surface wiping means provided so as to abut on a lower surface of the pallet for cleaning the lower surface of the pallet.

14. A pallet work line comprising:

a first pallet wiping device that receives one or more stacked pallets and outputs an unstacked pallet to a subsequent stage;

a work line that performs a certain procedure on the pallet output from the first pallet wiping device and outputs the pallet to a subsequent stage; and a second pallet wiping device that stacks the pallet output from the work line and outputs a plurality of stacked pallets to a subsequent stage, wherein each of the first and second pallet wiping devices is formed according to claim 1, the first pallet wiping device further includes an unstacker that unstacks a plurality of stacked pallets one by one, the unstacker having a supporter that supports a bottom pallet of one or more stacked pallets at a position at a certain height, and a lifter including a table on which a pallet is placed, the lifter being capable of raising and lowering a pallet with the pallet being placed on the table; and wiping means provided in the unstacker so as to abut on a side surface of a pallet lowered by the lifter for cleaning the side surface of the pallet, wherein the supporter releases support to the bottom pallet in a state in which the lifter supports a lower surface of the bottom pallet from below with the table, the lifter lowers the stacked pallets until a pallet immediately above the bottom pallet of the stacked pallets reaches the position at a certain height, the supporter supports the pallet immediately above the bottom pallet, the lifter lowers the bottom pallet to a certain position with the bottom pallet being placed on the table, and the table of the lifter is included in the pallet placement unit, and the second pallet wiping device further includes a stacker that stacks pallets, the stacker having a supporter that supports a bottom pallet of one or more stacked pallets at a position at a certain height, and a lifter including a table on which a pallet to be stacked is placed, the lifter being capable of raising and lowering the pallet to be stacked with the pallet being placed on the table; and wiping means provided in the stacker so as to abut on a side surface of a pallet raised by the lifter for cleaning the side surface of the pallet, wherein the lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height, the supporter supports the pallet to be stacked that is raised by the lifter, at the position at a certain height, and the table of the lifter is included in the pallet placement unit.

15. The pallet work line according to claim 14, wherein the wiping means of the first pallet wiping device is formed of a material capable of absorbing a dust absorber, the dust absorber having an ability to chemically absorb dust, and the wiping means of the second pallet wiping device is formed of a water-absorbent material.

16. A pallet work line comprising:

a first pallet wiping device that receives one or more stacked pallets and outputs an unstacked pallet to a subsequent stage;

a work line that performs a certain procedure on the pallet output from the first pallet wiping device and outputs the pallet to a subsequent stage; and a second pallet wiping device that stacks the pallet output from the work line and outputs a plurality of stacked pallets to a subsequent stage, wherein each of the first and second pallet wiping devices is formed according to claim 1, the first pallet wiping device further includes an unstacker that unstacks a plurality of stacked pallets one by one, the unstacker having a supporter that supports a bottom pallet of one or more stacked pallets at a position at a certain height, and a lifter including a table on which a pallet is placed, the lifter being capable of raising and lowering a pallet with the pallet being placed on the table; and wiping means provided in the unstacker so as to abut on a side surface of a pallet lowered by the lifter for cleaning the side surface of the pallet, wherein the supporter releases support to the bottom pallet in a state in which the lifter supports a lower surface of the bottom pallet from below with the table, the lifter lowers the stacked pallets until a pallet immediately above the bottom pallet of the stacked pallets reaches the position at a certain height, the supporter supports the pallet immediately above the bottom pallet, the lifter lowers the bottom pallet to a certain position with the bottom pallet being placed on the table, and the table of the lifter is included in the pallet placement unit, and the second pallet wiping device further includes a stacker that stacks pallets, the stacker having a supporter that supports a bottom pallet of one or more stacked pallets at a position at a certain height, and a lifter including a table on which a pallet to be stacked is placed, the lifter being capable of raising and lowering the pallet to be stacked with the pallet being placed on the table; and wiping means provided in the stacker so as to abut on a side surface of a pallet raised by the lifter for cleaning the side surface of the pallet, wherein the lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height, the supporter supports the pallet to be stacked that is raised by the lifter, at the position at a certain height, and the table of the lifter is included in the pallet placement unit, and a feed line at the table in the lifter of the stacker for moving a pallet to be stacked and placing the moved pallet onto the table, wherein the feed line includes upper surface wiping means provided so as to abut on an upper surface of the pallet moved to the table for cleaning the upper surface of the pallet, and lower surface wiping means provided so as abut on a lower surface of the pallet for cleaning the lower surface of the pallet.

17. A pallet work line comprising:

a first pallet wiping device that receives one or more stacked pallets and outputs an unstacked pallet to a subsequent stage;

a work line that performs a certain procedure on the pallet output from the first pallet wiping device and outputs the pallet to a subsequent stage; and a second pallet wiping device that stacks the pallet output from the work line and outputs a plurality of stacked pallets to a subsequent stage, wherein each of the first and second pallet wiping devices is formed according to claim 1, the first pallet wiping device further includes an unstacker that unstacks a plurality of stacked pallets one by one, the unstacker having a supporter that supports a bottom pallet of one or more stacked pallets at a position at a certain height, and a lifter including a table on which a pallet is placed, the lifter being capable of raising and lowering a pallet with the pallet being placed on the table; and wiping means provided in the unstacker so as to abut on a side surface of a pallet lowered by the lifter for cleaning the side surface of the pallet, wherein the supporter releases support to the bottom pallet in a state in which the lifter supports a lower surface of the bottom pallet from below with the table, the lifter lowers the stacked pallets until a pallet immediately above the bottom pallet of the stacked pallets reaches the position at a certain height, the supporter supports the pallet immediately above the bottom pallet, the lifter lowers the bottom pallet to a certain position with the bottom pallet being placed on the table, and the table of the lifter is included in the pallet placement unit, and an ejection line for moving a pallet unstacked from a plurality of stacked pallets by the unstacker and placed onto the table of the lifter and for ejecting the moved pallet from the unstacker, wherein the ejection line has upper surface wiping means provided so as to abut on an upper surface of the pallet moved from the table to be ejected from the unstacker for cleaning the upper surface of the pallet, and lower surface wiping means provided so as to abut on a lower surface of the pallet for cleaning the lower surface of the pallet, and the second pallet wiping device further includes a stacker that stacks pallets, the stacker having a supporter that supports a bottom pallet of one or more stacked pallets at a position at a certain height, and a lifter including a table on which a pallet to be stacked is placed, the lifter being capable of raising and lowering the pallet to be stacked with the pallet being placed on the table; and wiping means provided in the stacker so as to abut on a side surface of a pallet raised by the lifter for cleaning the side surface of the pallet, wherein the lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height, the supporter supports the pallet to be stacked that is raised by the lifter, at the position at a certain height, and the table of the lifter is included in the pallet placement unit.

18. A pallet work line comprising:

a first pallet wiping device that receives one or more stacked pallets and outputs an unstacked pallet to a subsequent stage;

a work line that performs a certain procedure on the pallet output from the first pallet wiping device and outputs the pallet to a subsequent stage; and a second pallet wiping device that stacks the pallet output from the work line and outputs a plurality of stacked pallets to a subsequent stage, wherein each of the first and second pallet wiping devices is formed according to claim 1, the first pallet wiping device further includes an unstacker that unstacks a plurality of stacked pallets one by one, the unstacker having a supporter that supports a bottom pallet of one or more stacked pallets at a position at a certain height, and a lifter including a table on which a pallet is placed, the lifter being capable of raising and lowering a pallet with the pallet being placed on the table; and wiping means provided in the unstacker so as to abut on a side surface of a pallet lowered by the lifter for cleaning the side surface of the pallet, wherein the supporter releases support to the bottom pallet in a state in which the lifter supports a lower surface of the bottom pallet from below with the table, the lifter lowers the stacked pallets until a pallet immediately above the bottom pallet of the stacked pallets reaches the position at a certain height, the supporter supports the pallet immediately above the bottom pallet, the lifter lowers the bottom pallet to a certain position with the bottom pallet being placed on the table, and the table of the lifter is included in the pallet placement unit, and an ejection line for moving a pallet unstacked from a plurality of stacked pallets by the unstacker and placed onto the table of the lifter and for ejecting the moved pallet from the unstacker, wherein the ejection line has upper surface wiping means provided so as to abut on an upper surface of the pallet moved from the table to be ejected from the unstacker for cleaning the upper surface of the pallet, and lower surface wiping means provided so as to abut on a lower surface of the pallet for cleaning the lower surface of the pallet, and the second pallet wiping device further includes a stacker that stacks pallets, the stacker having a supporter that supports a bottom pallet of one or more stacked pallets at a position at a certain height, and a lifter including a table on which a pallet to be stacked is placed, the lifter being capable of raising and lowering the pallet to be stacked with the pallet being placed on the table; and wiping means provided in the stacker so as to abut on a side surface of a pallet raised by the lifter for cleaning the side surface of the pallet, wherein the lifter raises the pallet to be stacked to a position where an upper surface of the pallet to be stacked comes into contact with a lower surface of the bottom pallet, and further raises the pallet to be stacked and the stacked pallets put on the pallet to be stacked until the pallet to be stacked reaches the position at a certain height, the supporter supports the pallet to be stacked that is raised by the lifter, at the position at a certain height, and the table of the lifter is included in the pallet placement unit, and a feed line at the table in the lifter of the stacker for moving a pallet to be stacked and placing the moved pallet onto the table, wherein the feed line includes upper surface wiping means provided so as to abut on an upper surface of the pallet moved to the table for cleaning the upper surface of the pallet, and lower surface wiping means provided so as abut on a lower surface of the pallet for cleaning the lower surface of the pallet.

* * * * *